US009903091B2

(12) United States Patent
Tsukada et al.

(10) Patent No.: US 9,903,091 B2
(45) Date of Patent: Feb. 27, 2018

(54) QUICK COUPLER

(71) Applicant: KOMATSU LTD., Tokyo (JP)

(72) Inventors: Takuya Tsukada, Takatsuki (JP); Kenichi Higuchi, Hirakata (JP); Akira Hashimoto, Hirakata (JP); Hisao Asada, Kyotanabe (JP); Tsuyoshi Yoshida, Tokyo (JP); Daijiro Ito, Hirakata (JP)

(73) Assignee: KOMATSU LTD., Tokyo (JP)

( * ) Notice: Subject to any disclaimer, the term of this patent is extended or adjusted under 35 U.S.C. 154(b) by 0 days.

(21) Appl. No.: 15/123,389

(22) PCT Filed: Jun. 23, 2015

(86) PCT No.: PCT/JP2015/068061

§ 371 (c)(1),
(2) Date: Sep. 2, 2016

(87) PCT Pub. No.: WO2015/199081

PCT Pub. Date: Dec. 30, 2015

(65) Prior Publication Data

US 2017/0067223 A1 Mar. 9, 2017

(30) Foreign Application Priority Data

Jun. 26, 2014 (JP) ..... 2014-131345
Mar. 16, 2015 (JP) ..... 2015-052028

(51) Int. Cl.
*E02F 3/36* (2006.01)
*E02F 9/22* (2006.01)

(52) U.S. Cl.
CPC ..... *E02F 3/3604* (2013.01); *E02F 3/365* (2013.01); *E02F 3/3618* (2013.01);
(Continued)

(58) Field of Classification Search
CPC ..... E02F 3/3663; E02F 3/3604; E02F 3/3618; E02F 3/3622; Y10T 403/591; Y10T 403/593; Y10T 403/22
See application file for complete search history.

(56) References Cited

U.S. PATENT DOCUMENTS 5,865,594 A * 2/1999 Kim ..... E02F 3/3411 37/468
6,379,075 B1 * 4/2002 Shamblin ..... E02F 3/3613 37/468

(Continued)

FOREIGN PATENT DOCUMENTS

CA 2813185 A1 * 4/2011 ..... E02F 3/3618
CN 1375601 A 10/2002

(Continued)

OTHER PUBLICATIONS

The Office Action for the corresponding Japanese application No. 2016-529602, dated Feb. 28, 2017.

(Continued)

*Primary Examiner* — Jonathan Masinick
(74) *Attorney, Agent, or Firm* — Global IP Counselors, LLP

(57) ABSTRACT

A quick coupler includes a coupler body having a first hook, a lock member, a slidable second hook, a hydraulic cylinder, and a connecting pin connecting the cylinder and coupler body. The lock member is movable between locking and unlocking positions in which the lock member protrudes into and retracts from an opening of the first hook. The cylinder includes first and second end portions connected to the coupler body and the second hook, respectively. The cylinder extends and contracts to cause the second hook to slide away from and towards the first hook, respectively. The coupler body includes a support hole moveably supporting the connecting pin in an extension and contraction direction (Continued)

of the cylinder. The first end portion of the cylinder moves away from the second end portion within a movability range of the connecting pin to move the lock member from the unlocking to locking position.

9 Claims, 18 Drawing Sheets

(52) U.S. Cl.
CPC ..... *E02F 3/3622* (2013.01); *E02F 3/3627* (2013.01); *E02F 3/3663* (2013.01); *E02F 9/2271* (2013.01)

(56) References Cited

U.S. PATENT DOCUMENTS

| | | | | |
|---|---|---|---|---|
| 2002/0157287 | A1 | 10/2002 | Mieger et al. | |
| 2006/0037220 | A1 | 2/2006 | Cunningham et al. | |
| 2007/0166143 | A1 | 7/2007 | Hart et al. | |
| 2009/0007465 | A1* | 1/2009 | Robl | E02F 3/3622 37/468 |
| 2010/0150643 | A1 | 6/2010 | Puttmann | |
| 2010/0189535 | A1* | 7/2010 | Nye | E02F 3/3636 414/723 |
| 2013/0160269 | A1* | 6/2013 | Parker | E02F 3/3618 29/428 |
| 2013/0234415 | A1 | 9/2013 | Essex | |
| 2013/0318841 | A1* | 12/2013 | Robl | E02F 3/3618 37/468 |

FOREIGN PATENT DOCUMENTS

| | | | | |
|---|---|---|---|---|
| CN | 101001995 | A | 7/2007 | |
| DE | 9314409 | U1 * | 3/1994 | E02F 3/3627 |
| EP | 1318242 | A2 * | 6/2003 | E02F 3/3618 |
| JP | 5-256307 | A | 10/1993 | |
| JP | 1-166571 | A | 6/1995 | |
| JP | 2001-179570 | A | 7/2001 | |
| JP | 2008-174920 | A | 7/2008 | |
| JP | 2010-523908 | A | 7/2010 | |
| JP | 2010-532438 | A | 10/2010 | |
| JP | 2011-236593 | A | 11/2011 | |
| WO | WO 02088476 | A1 * | 11/2002 | E02F 3/3618 |
| WO | WO 2008138932 | A2 * | 11/2008 | E02F 3/3622 |
| WO | WO 2011071394 | A1 * | 6/2011 | E02F 3/3618 |
| WO | WO 2015060730 | A1 * | 4/2015 | E02F 3/3618 |
| WO | WO 2015099543 | A1 * | 7/2015 | E02F 3/3618 |

OTHER PUBLICATIONS

The Office Action for the corresponding Korean application No. 10-2016-7022163 dated May 30, 2017.
The International Search Report for the corresponding international application No. PCT/JP2015/068061, dated Sep. 29, 2015.
The Office Action for the corresponding Chinese application No. 201580010941.6 dated Jul. 24, 2017.

* cited by examiner

QUICK COUPLER

CROSS-REFERENCE TO RELATED APPLICATIONS

This application is a U.S. National stage application of International Application No. PCT/JP2015/068061, filed on Jun. 23, 2015. This U.S. National stage application claims priority under 35 U.S.C. § 119(a) to Japanese Patent Application No. 2014-131345, filed in Japan on Jun. 26, 2014, and Japanese Patent Application No. 2015-052028, filed in Japan on Mar. 16, 2015, the entire contents of which are hereby incorporated herein by reference.

BACKGROUND

Field of the Invention

The present invention relates to a quick coupler.

Background Information

Various types of attachments such as a bucket, a cutter, a breaker, a fork and the like are attached to a work vehicle such as a hydraulic excavator. A quick coupler is known as a component for easily attaching these types of attachments to the work vehicle. The quick coupler is attached to the work vehicle.

For example, the quick coupler described in Japanese Laid-Open Patent Publication No. H7-166571 includes a fixed hook and a moveable hook and these hooks lock with two pins provided on the attachment whereby the attachment is connected to the quick coupler.

When the attachment is attached to the quick coupler with the abovementioned hooks, a lock member is preferably provided to retain the pins in the hooks. For example, the quick coupler described in Japanese Laid-Open Patent Publication No. H7-166571 is made to retain the pins in the hooks by inserting a lock pin in a boss provided on the moveable hook.

However, the lock pin is installed by an operator in the quick coupler described in Japanese Laid-Open Patent Publication No. H7-166571. Because this type of work is complicated, a retaining function is preferably carried out automatically with the lock member when attaching the attachment.

A first arm and a second arm are pivotally attached via a support pin in the quick coupler described in Japanese Laid-open Patent Publication No. 2008-174920. Moreover, a hydraulic cylinder is attached across the first arm and the second arm. Due to the extension of the hydraulic cylinder, a gap between the first arm and the second arm widens whereby an attachment pin is connected to the first arm and the second arm. Moreover, the hydraulic cylinder rotates so as to become horizontal due to the extension of the hydraulic cylinder. Retaining is maintained by a lock member due to the rotation of the hydraulic cylinder and the rotation of the lock member.

SUMMARY

A retaining function can be automatically actuated due to the lock member when attaching the attachment in the above quick coupler described in Japanese Laid-open Patent Publication No. 2008-174920. However, in order to operate the lock member, the large action of rotating the hydraulic cylinder is required. As a result, there is a problem that the size of the quick coupler is increased.

An object of the present invention is to provide a quick coupler that is small in size and that can enable the automatic actuation of a retaining function with the lock member when attaching the attachment.

A quick coupler according to a first aspect of the present invention is provided with a coupler body, a lock member, a second hook, a hydraulic cylinder, and a connecting pin. The coupler body includes a first hook. The lock member is able to move between a locking position and an unlocking position. The lock member protrudes into an opening of the first hook in the locking position. The lock member retracts from the locking position in the unlocking position. The second hook is provided in a manner that allows sliding with respect to the coupler body. The hydraulic cylinder includes a first end part connected to the coupler body and a second end portion connected to the second hook. The hydraulic cylinder extends to cause the second hook to slide away from the first hook. The hydraulic cylinder contracts to cause the second hook to slide towards the first hook. The connecting pin connects the first end portion of the hydraulic cylinder and the coupler body. The coupler body includes a support hole. The support hole moveably supports the connecting pin in the extension and contraction direction of the hydraulic cylinder. The first end portion of the hydraulic cylinder moves away from the second end portion within the movability range of the connecting pin and thereby moves the lock member from the unlocking position to the locking position.

The second end portion of the hydraulic cylinder moves way from the first end portion due to the extension of the hydraulic cylinder in the quick coupler according to the present aspect. As a result, the second hook slides away from the first hook. Consequently, the first hook and the second hook both lock with the pins of the attachment and the attachment is attached to the quick coupler.

Moreover, the support hole in the coupler body moveably supports the connecting pin in the extension and contraction direction of the hydraulic cylinder. As a result, when the hydraulic cylinder extends, the first end portion of the hydraulic cylinder also moves away from the second end portion within the movability range of the connecting pin. The lock member moves from the unlocking position to the locking position along with the motion of the first end portion.

As described above, the retaining function can be automatically actuated due to the lock member when attaching the attachment in the quick coupler according to the present aspect. Moreover, by allowing the first end portion of the hydraulic cylinder to move within the movability range of the connecting pin, the retaining function by the lock member can be actuated. Therefore, the retaining function with the lock member can be actuated due to a small motion of the first end portion. As a result, the size of the quick coupler can be reduced.

Preferably, the support hole is an elongated hole that extends in the extension and contraction direction of the hydraulic cylinder. In this case, the first end portion moves in the extension and contraction direction of the hydraulic cylinder along the elongated hole whereby the retaining function with the lock member can be actuated. As a result, the structure of the quick coupler can be simplified.

The quick coupler preferably is a member for attaching an attachment via a first pin and a second pin and the coupler body further includes a pin retaining portion. The pin retaining portion is disposed facing the opening of the second hook. The width of a gap between the tip of the second hook and the pin retaining portion is less than the diameter of the second pin when the second hook is locked with the second pin.

In this case, even if the first hook is damaged, the pin is prevented from going through the gap between the tip of the second hook and the pin retaining portion. As a result, detachment of the attachment can be prevented.

The quick coupler is preferably further provided with an urging member. The urging member urges the second end portion so that the second end portion moves away from the first end portion. In this case, even if the extension force of the hydraulic cylinder is lost due to a breakdown of the hydraulic system, the second hook is maintained in the locked state with the pin due to the urging member. Moreover, because the state of the first end portion being spaced away from the second end portion is maintained by the urging member, the lock member is held in the locking position. As a result, detachment of the attachment can be prevented.

The urging member preferably is disposed inside the hydraulic cylinder. In this case, when the quick coupler is operated, the urging member is prevented from coming into contact with another member such as a hydraulic pipe around the hydraulic cylinder.

The quick coupler is preferably further provided with an elastic member inserted into the support hole. In this case, resistance is brought about due to the elastic force of the elastic member when the first end portion moves. As a result, the timing of the actuation or the release of the retaining function with the lock member can be adjusted.

The lock member preferably includes a proximal end portion, a distal end portion, and a recessed portion. The proximal end portion is supported in a rotatable manner on the coupler body. The distal end portion protrudes into the opening of the first hook in the locking position. The recessed portion is positioned between the proximal end portion and the distal end portion. The first end portion of the hydraulic cylinder includes a convex portion that protrudes towards the lock member. The lock member is positioned in the unlocking position when the convex portion is positioned in the recessed portion.

In this case, the lock member can be positioned in the unlocking position by disposing the first end portion in the position so that the convex portion is positioned in the recessed portion.

The lock member preferably includes an inclined surface connected to the recessed portion. The inclined surface is disposed in the direction from the second end portion to the first end portion with respect to the recessed portion. The convex portion moves from the recessed portion to the inclined surface and presses against the inclined surface whereby the lock member moves to the locking position.

In this case, the convex portion moves from the recessed portion to the inclined surface and presses against the inclined surface when the hydraulic cylinder extends and the first end portion moves in the direction away from the second end portion. As a result, the lock member can be moved from the unlocking position to the locking position.

The coupler body preferably includes a wall portion. The wall portion is disposed facing the first end portion in the extension and contraction direction of the hydraulic cylinder. In this case, the hydraulic cylinder remains inside the coupler body due to the wall portion even if the connecting pin is damaged. As a result, the pins of the attachment can be prevented from coming off from the first hook and the second hook. As a result, detachment of the attachment can be prevented.

The first end portion of the hydraulic cylinder preferably moves toward the second end portion within the movability range of the connecting pin whereby the lock member is moved from the locking position to the unlocking position. In this case, the retaining function with the lock member can be automatically released when removing the attachment. Moreover, by allowing the first end portion of the hydraulic cylinder to move within the movability range of the connecting pin, the retaining function by the lock member can be released. Therefore, the retaining function with the lock member can be released due to a small motion of the first end portion. As a result, the size of the quick coupler can be reduced.

The second hook preferably includes a protruding portion. The coupler body includes a groove in which the protruding portion is disposed. The protruding portion moves along the groove whereby the second hook slides with respect to the coupler body. Preferably, a stopper member for retaining the second hook is attached to the groove. In this case, the retaining of the second hook can be strengthened.

Next, a first aspect of the hydraulic cylinder will be discussed.

Conventionally, a spring is provided inside the hydraulic cylinder, and the position of a piston is held in a predetermined position with the force of the spring when no hydraulic fluid is supplied, and the spring is compressed and the piston contracts when hydraulic fluid is supplied (see, for example, Japanese Laid-Open Patent Publication No. H05-256307).

The spring is disposed on the outer periphery of a piston rod via a spring seat in the hydraulic cylinder described in Japanese Laid-Open Patent Publication No. H05-256307. Spring seats are disposed on both ends of the spring and are provided to prevent the spring from becoming excessively compressed.

However, because the spring seats are disposed for bearing the spring in the hydraulic cylinder described in Japanese Laid-Open Patent Publication No. H05-256307, the spring can only be contracted to the position where the two spring seats come into contact and a loss occurs in the contraction margin.

As a result, there is a need for the size of the hydraulic cylinder itself to be increased to make the stroke larger.

The hydraulic cylinder according to the present aspect may be provided with the following features for the purpose of providing a hydraulic cylinder that takes into account the above conventional problem.

The hydraulic cylinder is provided with a cylinder tube, a piston rod, a piston, and a spring member. The piston rod is inserted into the cylinder tube such that the longitudinal direction of the piston rod extends in the extension and contraction direction. The piston is fixed to the piston rod and slides inside the cylinder tube. The spring member is disposed in the extension and contraction direction of the piston rod and urges the piston rod in the extension direction. An opening is held on an end surface on the contraction direction side of the piston rod and an internal space is formed from the opening in the extension direction. The spring member is inserted in the internal space.

According to the hydraulic cylinder as in the present aspect, a hydraulic cylinder that can achieve a large stroke in a compact manner can be provided.

A cylindrical guide member is preferably further provided. The spring member has a coil shape. The guide member is disposed inside the spring member so that the longitudinal direction of the guide member follows the extension and contraction direction. One end of the guide member is held on the bottom surface of the cylinder tube facing the end surface of the piston rod.

At least one end side of the guide member preferably has a cylindrical shape. The cylinder tube includes a protruding portion that projects from the bottom surface in the extension direction. The one end of the guide member is held on the bottom surface due to the protruding portion being fitted to the cylindrical inner side.

The spring member preferably has a coil shape. The length of the spring member is less than the natural length in the state in which the hydraulic cylinder is extended the most.

The hydraulic cylinder is further preferably provided with a ring-like member. The ring-like member is disposed between the outer circumferential surface of the guide member and the inner circumferential surface of the internal space and slides on the outer circumferential surface and the inner circumferential surface. The spring member is divided into a first spring member and a second spring member with the ring-like member sandwiched therebetween.

The guide member preferably includes a protrusion that protrudes toward the outside in the radial direction. The end on the extension direction side of the first spring member abuts the inner surface on the extension direction side of the internal space. The end on the contraction direction side of the second spring member abuts the protrusion.

The guide member preferably is formed integrally with the bottom surface.

The spring member preferably has a coil shape. The cylinder tube includes a protruding portion that projects in the extension direction from the bottom surface facing the end surface of the piston rod. The protruding portion fits into the inside of the end of the spring member.

According to the present invention, a quick coupler can be provided that is small in size and that can enable the automatic actuation of a retaining function with the lock member when attaching the attachment.

DESCRIPTION OF EMBODIMENTS

A quick coupler according to the embodiments will be discussed with reference to the drawings.

Figure 1:
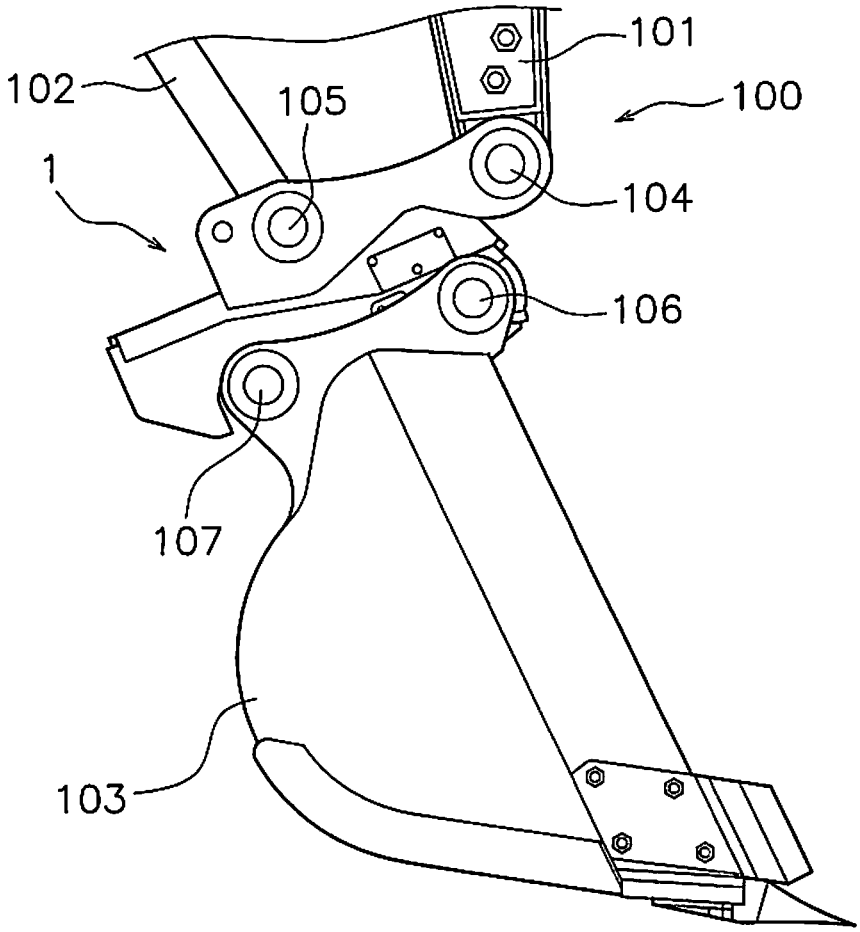
FIG. 1 is a side surface view of a portion of a hydraulic excavator including a quick coupler according to a first embodiment attached thereto.

FIG. 1 is a side surface view of a portion of a hydraulic excavator 100 including a quick coupler according to a first embodiment attached thereto. The work vehicle 100 is a hydraulic excavator for example. However, the work vehicle 100 is not limited to a hydraulic excavator and may be another type of work vehicle.

As illustrated in FIG. 1, the work vehicle 100 includes an arm 101, a link member 102, and an attachment 103. While the attachment 103 is depicted as a bucket as an example in FIG. 1, the attachment 103 is not limited to a bucket and may be another type of attachment such as a cutter, a breaker, or a fork and the like.

A quick coupler 1 is connected to the arm 101 via an arm pin 104. The quick coupler 1 is connected to the link member 102 via a link pin 105. The quick coupler 1 is connected to the attachment 103 via a first pin 106 and a second pin 107.

Figure 2:
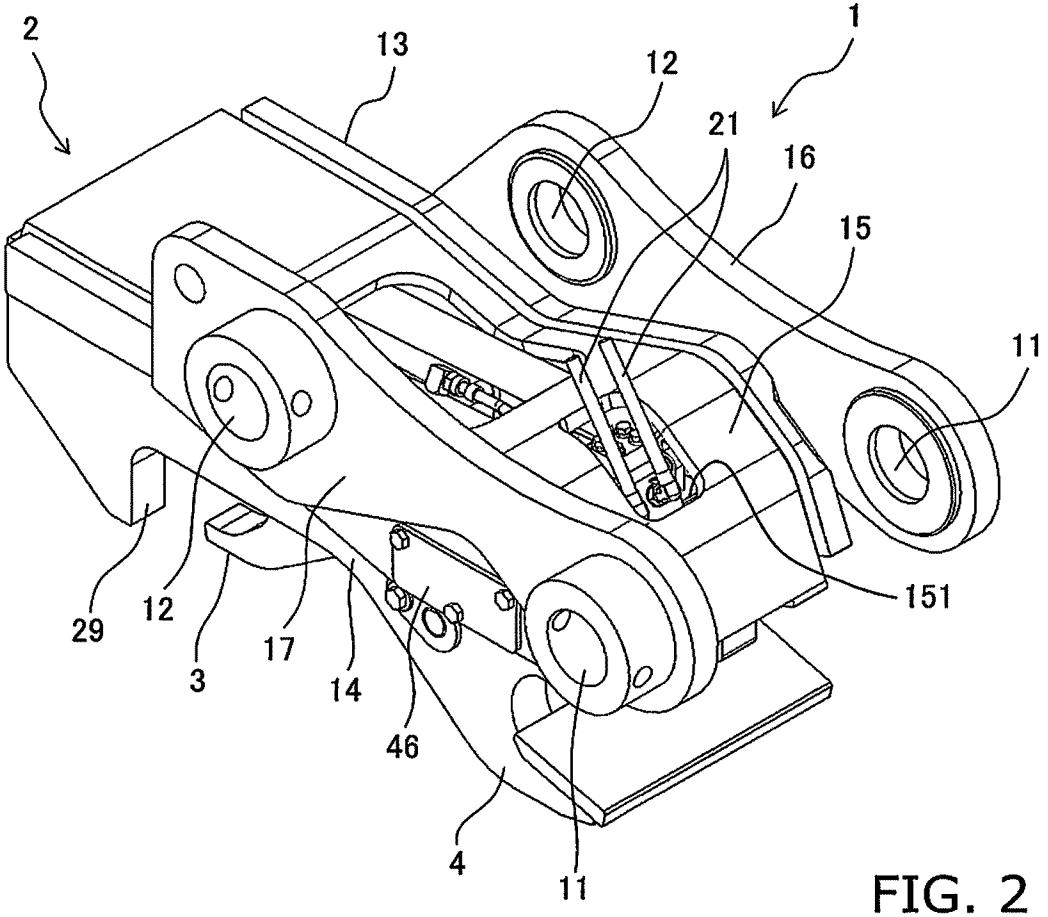
FIG. 2 is a perspective view of the quick coupler according to the first embodiment.
Figure 3:
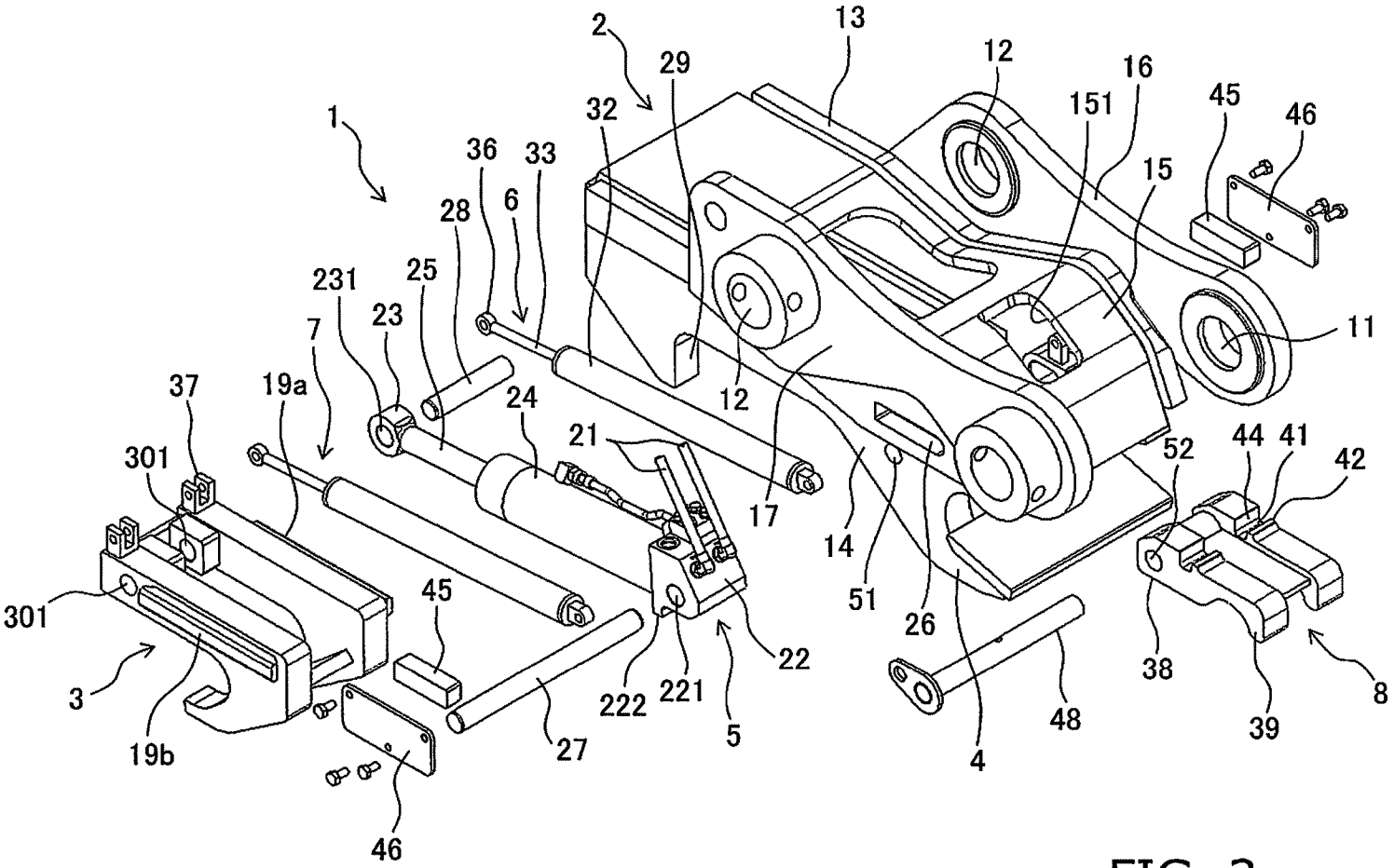
FIG. 3 is an exploded view of the quick coupler according to the first embodiment.

FIG. 2 is a perspective view of the quick coupler 1. FIG. 3 is an exploded view of the quick coupler 1. As illustrated in FIGS. 2 and 3, the quick coupler 1 includes a coupler body 2 and a second hook 3. The coupler body 2 includes an arm pin support hole 11 and a link pin support hole 12. The arm pin 104 is inserted into the arm pin support hole 11. The link pin 105 is inserted into the link pin support hole 12.

The coupler body 2 includes a first hook 4. The first hook 4 locks the first pin 106. The second hook 3 is separate from the coupler body 2. The second hook 3 locks the second pin 107.

The direction in which the link pin support hole 12 is positioned with respect to the arm pin support hole 11 is referred to as forward and the opposite direction is referred to rearward in the quick coupler 1 according to the present embodiment. The direction where the first hook 4 and the second hook 3 are positioned with regard to the arm pin support hole 11 and the link pin support hole 12 is referred to as downward and the opposite direction is referred to as upward. The direction of the axis line of the arm pin support hole 11 and the axis line of the link pin support hole 12 is referred to as the width direction or laterally. However, the terms indicating the directions are specified when viewing the quick coupler 1 as described above and are not limited to the attachment direction of the quick coupler 1.

The coupler body 2 includes a first side surface portion 13, a second side surface portion 14, and a wall portion 15. The first side surface portion 13 and the second side surface portion 14 have a planar shape that extends in the front-back direction and the up-down direction. The first side surface portion 13 and the second side surface portion 14 are disposed with a gap therebetween in the width direction. The wall portion 15 extends in the width direction and is disposed across the first side surface portion 13 and the second side surface portion 14.

The coupler body 2 includes a first upper surface portion 16 and a second upper surface portion 17. The first upper surface portion 16 and the second upper surface portion 17 have a planar shape that extends in the front-back direction and the up-down direction. The first upper surface portion 16 protrudes upward from the first side surface portion 13. The second upper surface portion 17 protrudes upward from the second side surface portion 14. The arm pin support hole 11 and the link pin support hole 12 are provided so as to penetrate the first upper surface portion 16 and the second upper surface portion 17 in the width direction.

Figure 4:
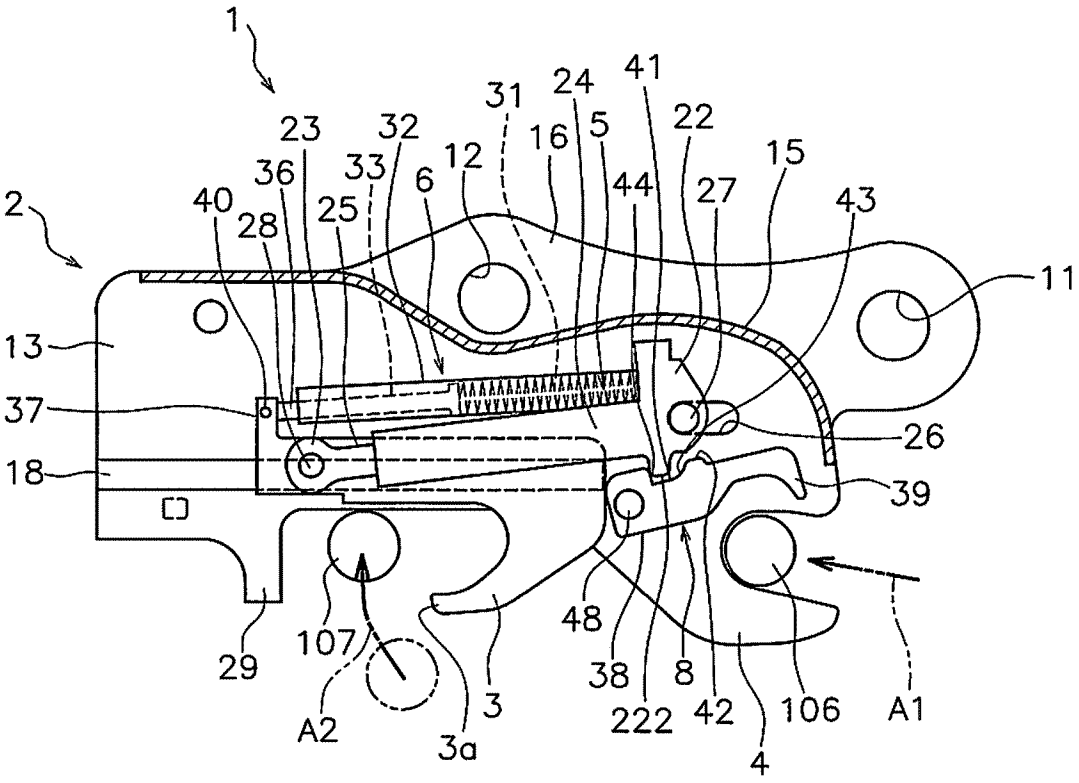
FIG. 4 is a side surface sectional view of a schematic configuration of the inside of the quick coupler according to the first embodiment.

FIG. 4 is a side surface sectional view of a schematic configuration of the inside of the quick coupler 1. As illustrated in FIG. 4, the first hook 4 and the second hook 3 are provided respectively with openings for locking the first pin 106 and the second pin 107, and are members including a curved recessed portion. The first hook 4 and the second hook 3 open in directions opposite from each other. Specifically the first hook 4 opens toward the rear. The second hook 3 opens toward the front. The second hook 3 is disposed in front of the first hook 4. The coupler body 2 includes a pin retaining portion 29. The pin retaining portion 29 is disposed facing the opening of the second hook 3.

The second hook 3 is supported by the coupler body 2 in a manner that allows sliding in the front-back direction. Specifically, a groove 18 that extends in the front-back direction is provided on the inside side surface of the first side surface portion 13. Although not illustrated in the drawings, a groove that extends in the front-back direction is provided similarly on the inside side surface of the second side surface portion 14. As illustrated in FIG. 3, the side surfaces of second hook 3 are each provided with protruding parts 19*a* and 19*b* that extend in the front-back direction. The protruding portion 19*a* of the second hook 3 is disposed inside the groove 18 on the first side surface portion 13. The protruding portion 19*b* of the second hook 3 is disposed inside the groove of the second side surface portion 14. The protruding parts 19 move along the groove 18 whereby the second hook 3 slides with respect to the coupler body 2. A component 3*a* connected to the opening of the recessed portion of the second hook 3 is parallel to the direction of the groove 18 extending in the front-back direction as seen from the side surface as illustrated in FIG. 4.

As illustrated in FIG. 3, the quick coupler 1 is provided with a hydraulic cylinder 5, a first urging member 6, a second urging member 7, and a lock member 8. The hydraulic cylinder 5 is connected to a hydraulic system of the work vehicle 100 via a hydraulic pipe 21. The hydraulic cylinder 5 extends and contracts due to hydraulic pressure from the hydraulic pipe 21.

The hydraulic cylinder 5 includes a first end portion 22 and a second end portion 23. The first end portion 22 is connected to the coupler body 2. The second end portion 23 is connected to the second hook 3. Specifically, the hydraulic cylinder 5 includes a cylinder tube 24 and a piston rod 25. The first end portion 22 is included in the cylinder tube 24. The second end portion 23 is included in the piston rod 25.

The coupler body 2 includes a support hole 26. The support hole 26 is provided so as to penetrate the first side surface portion 13 and the second side surface portion 14. The first end portion 22 is supported by the coupler body 2 via a first connecting pin 27. The first end portion 22 includes a through-hole 221 that extends in the width direction. The first connecting pin 27 is inserted into the first end portion 22 and the support hole 26. The first connecting pin 27 connects the first end portion 22 of the hydraulic cylinder 5 to the coupler body 2. The support hole 26 is an elongated hole that extends the extension and contraction direction of the hydraulic cylinder, that is, in the front-back direction. As a result, the support hole 26 moveably supports the first connecting pin 27 in the extension and contraction direction of the hydraulic cylinder 5.

The second end portion 23 is connected to the second hook 3 via a second connecting pin 28. Specifically, the second end portion 23 includes a through-hole 231 that extends in the width direction. Moreover, the front portion of the second hook 3 includes a through-hole 301 that extends in the width direction. The second connecting pin 28 is inserted into the through-hole 231 of the second end portion 23 and the through-hole 301 of the second hook 3.

Figure 5:
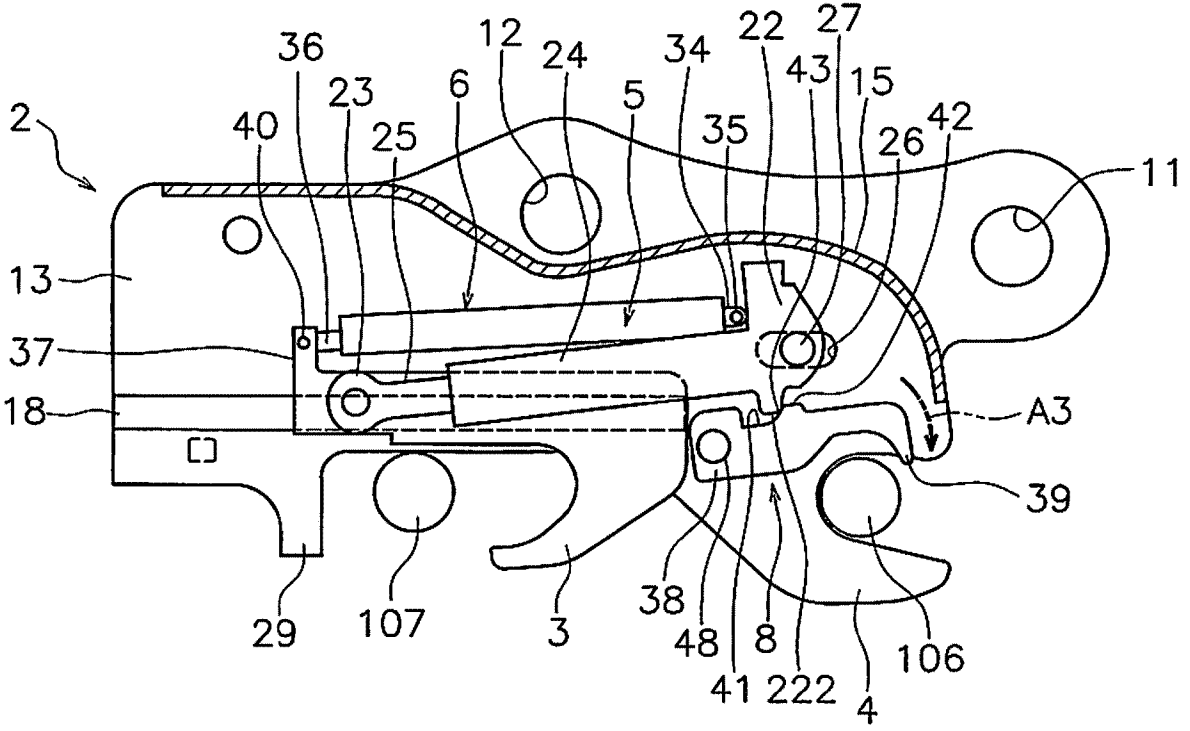
FIG. 5 is a side surface sectional view of a schematic configuration of the inside of the quick coupler according to the first embodiment.
Figure 6:
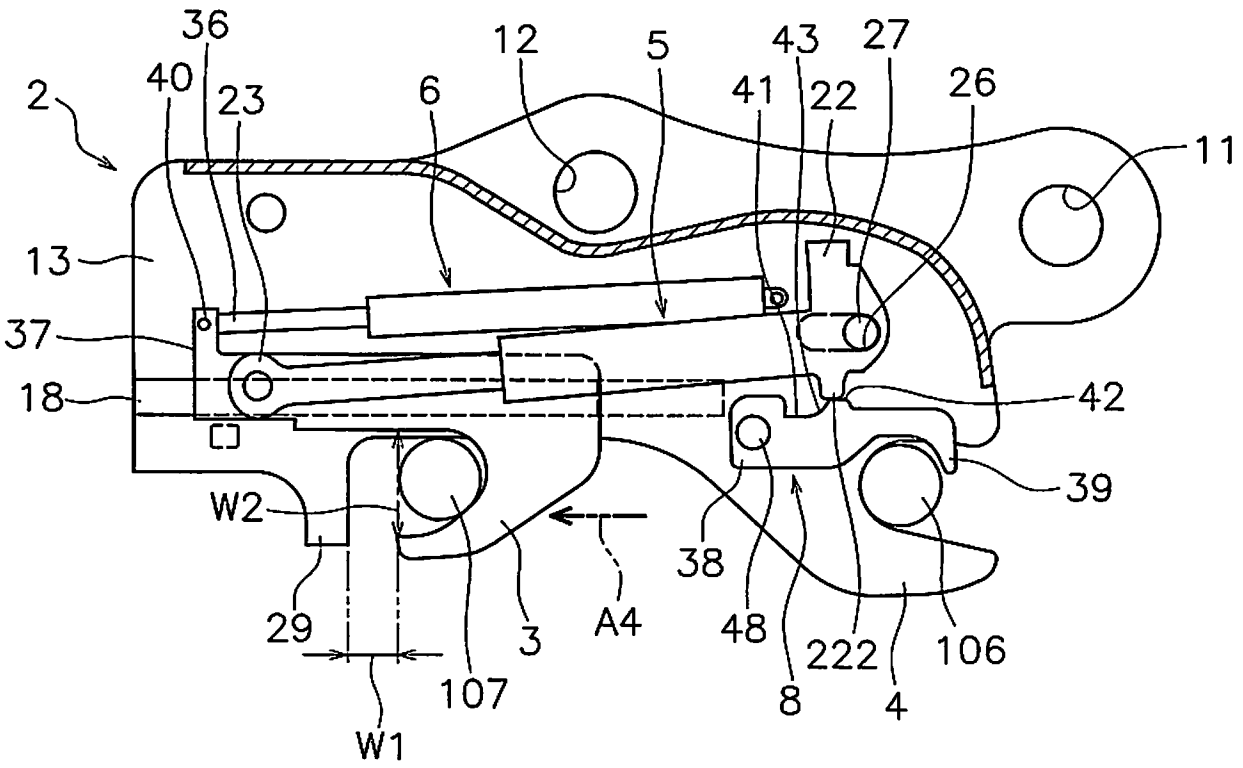
FIG. 6 is a side surface sectional view of a schematic configuration of the inside of the quick coupler according to the first embodiment.

FIG. 5 is a side surface sectional view illustrating a state in which the hydraulic cylinder 5 is extended from the state illustrated in FIG. 4. FIG. 6 is a side surface sectional view illustrating a state in which the hydraulic cylinder 5 is further extended from the state illustrated in FIG. 5. As illustrated in FIGS. 5 and 6, the second end portion 23 moves away from the first end portion 22 due to the extension of the hydraulic cylinder 5. As a result, the hydraulic cylinder 5 causes the second hook 3 to slide so that the second hook 3 moves away from the first hook 4.

Figure 7:
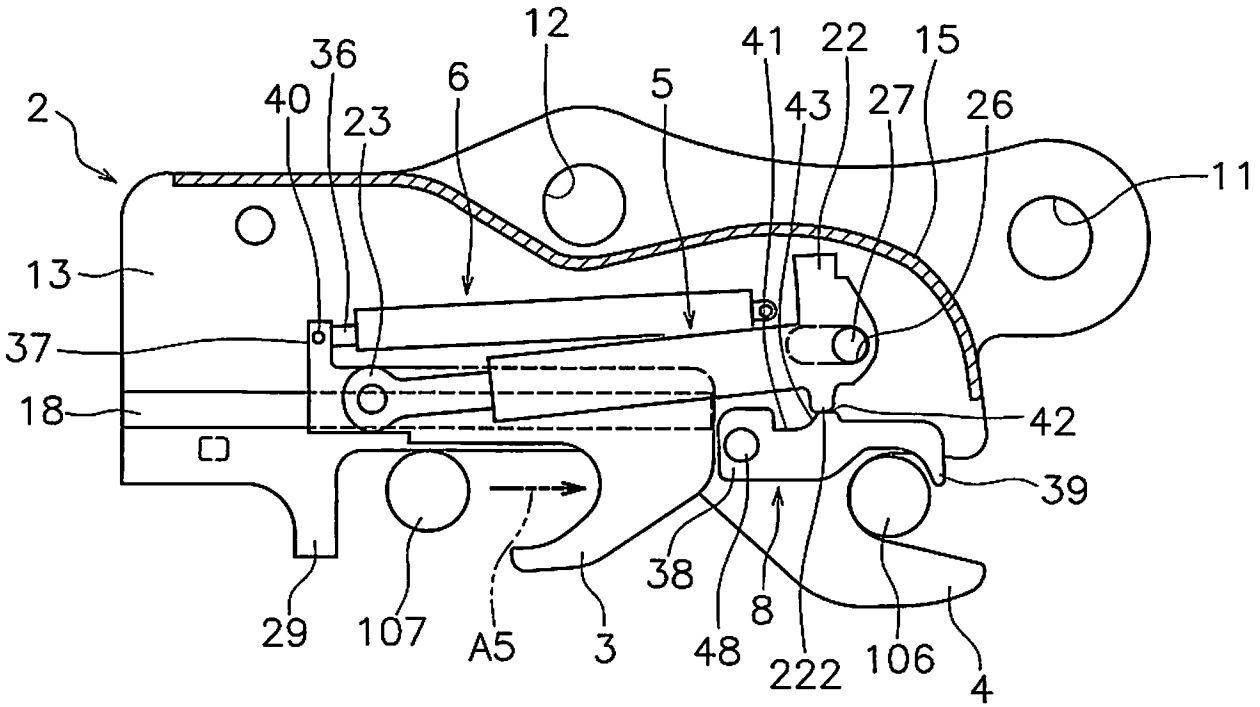
FIG. 7 is a side surface sectional view of a schematic configuration of the inside of the quick coupler according to the first embodiment.
Figure 8:
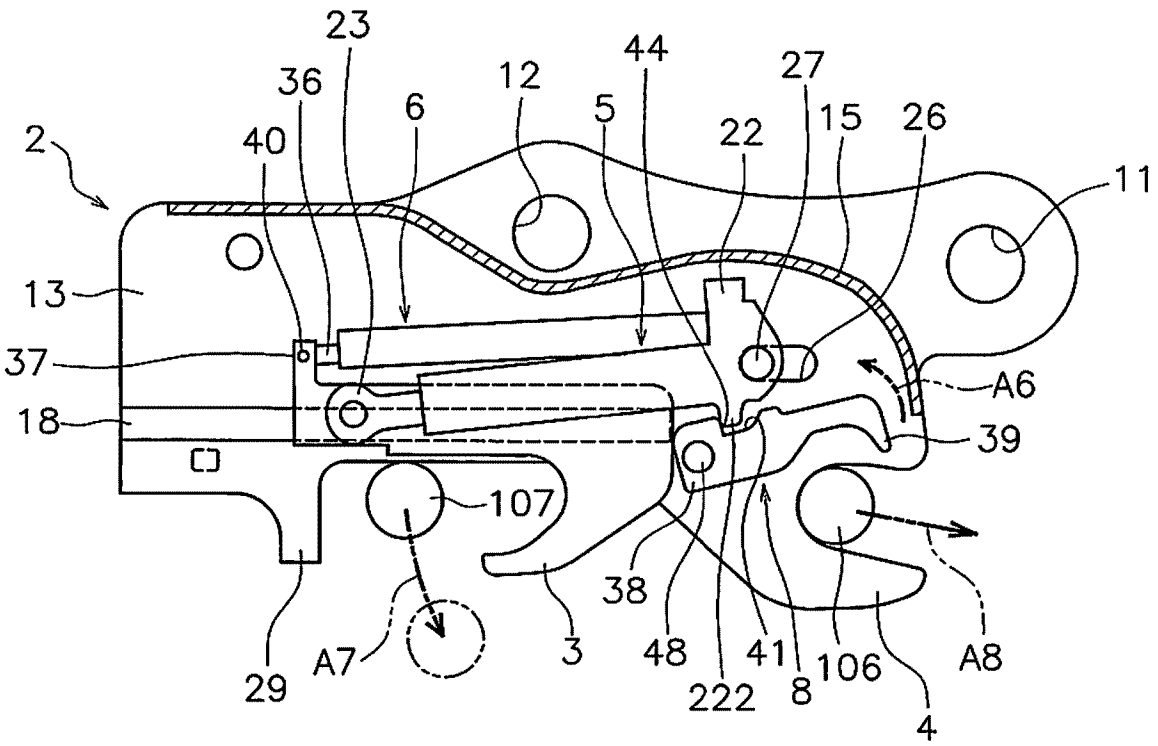
FIG. 8 is a side surface sectional view of a schematic configuration of the inside of the quick coupler according to the first embodiment.

FIG. 7 is a side surface sectional view illustrating a state in which the hydraulic cylinder 5 is contracted from the state illustrated in FIG. 6. FIG. 8 is a side surface sectional view illustrating a state in which the hydraulic cylinder 5 is contracted further from the state illustrated in FIG. 7. As illustrated in FIGS. 7 and 8, the second end portion 23 moves toward the first end portion 22 due to the contraction of the hydraulic cylinder 5. As a result, the hydraulic cylinder 5 causes the second hook 3 to slide so as to move closer to the first hook 4.

The first urging member 6 illustrated in FIG. 3 urges the second end portion 23 so that the second end portion 23 moves away from the first end portion 22. As illustrated in FIG. 4, the first urging member 6 includes a spring 31, a spring cover 32, and a shaft 33. The spring 31 is a coil spring and is disposed inside the spring cover 32. As illustrated in FIG. 5, an end portion 34 of the spring cover 32 is supported by the coupler body 2 via a connecting pin 35. The spring 31 inside the spring cover 32 is in a compressed state and presses the shaft 33. An end portion 36 of the shaft 33 protrudes from the spring cover 32. The second hook 3 includes a connecting portion 37. The connecting portion 37 is provided on the upper surface of the second hook 3. The end portion 36 of the shaft 33 is connected to the connecting portion 37 via a connecting pin 40. The second urging member 7 has the same configuration as the first urging member 6 and a detailed explanation will be omitted.

The abovementioned wall portion 15 is disposed above the first urging member 6 and the second urging member 7. Moreover, a portion of the wall portion 15 is disposed behind the hydraulic cylinder 5 and is disposed facing the first end portion 22 in the extension and contraction direction of the hydraulic cylinder 5.

As illustrated in FIGS. 2 and 3, the wall portion 15 includes an opening 151. The opening 151 is positioned above the first end portion 22. The hydraulic pipe 21 passes through the opening 151 and is guided into the coupler body 2.

The lock member 8 is disposed above the first hook 4. The lock member 8 is connected to the coupler body 2 via a lock connecting pin 48. As illustrated in FIG. 3, the coupler body 2 includes a through-hole 51. The lock member 8 includes a through-hole 52. The lock connecting pin 48 is inserted into the through-hole 51 of the coupler body 2 and the through-hole 52 of the lock member 8.

The lock member 8 includes a proximal end portion 38 and a distal end portion 39. The proximal end portion 38 is supported in a rotatable manner on the coupler body 2. The distal end portion 39 has a hook-like shape that is curved downward. That is, the distal end portion 39 includes a hook-like shape that is curved toward the first hook 4.

The lock member 8 is provided to allow movement between a locking position and an unlocking position. FIG. 4 illustrates a state of the lock member 8 positioned in the unlocking position. FIG. 6 illustrates a state of the lock member 8 positioned in the locking position.

As illustrated in FIG. 6, the distal end portion 39 of the lock member 8 protrudes into the opening of the first hook 4 in the locking position. As a result, the first pin 106 is retained in the first hook 4. As illustrated in FIG. 4, the distal end portion 39 of the lock member 8 enters a state of retracting from the locking position in the unlocking position. Specifically, the distal end portion 39 of the lock member 8 enters a state of retracting from the inside of the opening of the first hook 4 in the unlocking position.

The first end portion 22 of the hydraulic cylinder 5 moves to a holding position by moving away from the second end portion 23. FIG. 6 illustrates a state of the first end portion 22 positioned in the holding position. The first end portion 22 holds the lock member 8 in the locking position in the holding position. Conversely, the first end portion 22 moves to a release position by moving toward the second end portion 23. FIG. 4 illustrates a state of the first end portion 22 positioned in the release position. The first end portion 22 releases the hold of the lock member 8 in the release position.

Specifically, the first end portion 22 of the hydraulic cylinder 5 includes a convex portion 222 that protrudes toward the lock member 8. The convex portion 222 protrudes downward. The lock member 8 includes a recessed portion 41 and a receiving portion 42. The recessed portion 41 and the receiving portion 42 are positioned between the proximal end portion 38 and the distal end portion 39. The recessed portion 41 has a shape that is recessed downward from the upper surface of the lock member 8. The receiving portion 42 is positioned behind the recessed portion 41.

As illustrated in FIG. 6, the convex portion 222 comes into contact with the receiving portion 42 while the first end portion 22 is in the holding position, and the convex portion 222 presses the lock member 8 toward the first hook 4. As a result, the lock member 8 is held in the locking position. As illustrated in FIG. 4, the convex portion 222 is positioned inside the recessed portion 41 while the first end portion 22 is positioned in the release position. As a result, the lock member 8 is held in the unlocking position.

More specifically, the lock member 8 includes an inclined surface 43 and a step portion 44 connected to the recessed portion 41. The inclined surface 43 and the step portion 44 are positioned between the proximal end portion 38 and the distal end portion 39. The inclined surface 43 is disposed in the direction extending from the second end portion 23 to the first end portion 22 with respect to the recessed portion 41. That is, the inclined surface 43 is disposed behind the recessed portion 41. The step portion 44 is disposed in the direction extending from the first end portion 22 to the second end portion 23 with respect to the recessed portion 41. That is, the step portion 44 is disposed in front of the recessed portion 41.

As illustrated in FIGS. 4 to 6, the convex portion 222 moves from the recessed portion 41 to the inclined surface 43 and presses against the inclined surface 43 whereby the lock member 8 moves to the locking position. Moreover, as illustrated in FIGS. 7 and 8, the convex portion 222 moves from the recessed portion 41 to the step portion 44 and presses against the step portion 44 whereby the lock member 8 rotates and moves to the unlocking position.

Figure 9:
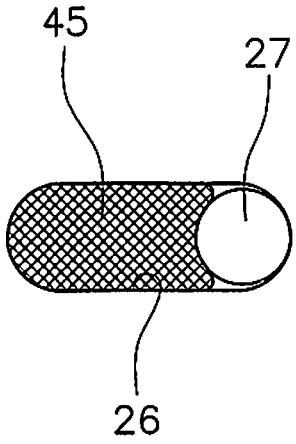
FIG. 9 is a side surface view of a support hole and an elastic member.
Figure 10:
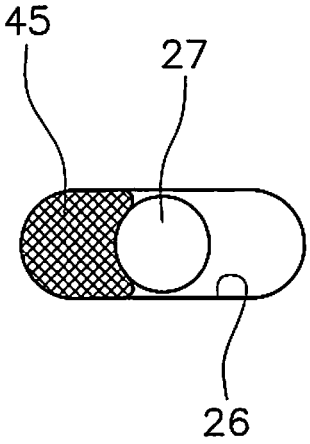
FIG. 10 is a side surface view of the support hole and the elastic member.

An elastic member 45 illustrated in FIG. 3 is inserted into the abovementioned support hole 26. The elastic member 45 is made of rubber for example. However, the elastic member 45 is not limited to rubber and may be another material so long as the material produces an elastic force. The elastic member 45 has a long thin shape that follows the support hole 26. FIG. 9 is a side surface view of the support hole 26 and the elastic member 45. As illustrated in FIG. 9, the elastic member 45 is disposed forward of the first connecting pin 27 inside the support hole 26. That is, the elastic member 45 is disposed so as to be compressed by the first connecting pin 27 as illustrated in FIG. 10 when the hydraulic cylinder 5 contracts. That is, the elastic member 45 is disposed so that the first connecting pin 27 receives resistance due to an elastic force when the first end portion 22 moves from the holding position to the release position. As illustrated in FIGS. 2 and 3, the support hole 26 is closed on the side by a cover member 46.

Next, operations for attaching the attachment 103 to the quick coupler 1 will be discussed. First, as illustrated in FIG. 4, the first pin 106 is locked with the first hook 4 (see arrow A1). Further, the quick coupler 1 or the attachment 103 rotates around the first pin 106 whereby the second pin 107 is disposed between the second hook 3 and the pin retaining portion 29 (see arrow A2). The hydraulic cylinder 5 is then extended.

As illustrated in FIG. 5, the first end portion 22 moves rearward along the support hole 26 so as to move away from the second end portion 23 when the hydraulic cylinder 5 extends. As a result, the convex portion 222 moves from the recessed portion 41 of the lock member 8 to the inclined surface 43 and the lock member 8 is rotated due to the convex portion 222 pressing against the inclined surface 43 (see arrow A3).

As illustrated in FIG. 6, the first end portion 22 then moves further rearward and when the first end portion 22 reaches the holding position, the convex portion 222 presses against the receiving portion 42 of the lock member 8. As a result, the lock member 8 reaches the locking position and the first pin 106 is retained in the first hook 4 due to the lock member 8. Moreover, the convex portion 222 presses against the receiving portion 42 whereby the lock member 8 is held in the locking position.

Moreover, the second end portion 23 moves forward so as to move away from the first end portion 22 due to the extension of the hydraulic cylinder 5. As a result, the second hook 3 slides forward so as to approach the pin retaining portion 29 and locks the second pin 107 (see arrows A4). The second hook 3 is held while the second hook 3 is locked with the second pin 107. Because the second hook 3 applies pressure to the second pin 107 due to the hydraulic cylinder 5, the first connecting pin 27 is firmly held at the rear end of the support hole 26. As a result, the lock member 8 is firmly held in the locking position.

As described above, the attachment 103 is attached to the quick coupler 1. As illustrated in FIG. 6, the second hook 3 is nearest to the pin retaining portion 29 while the attachment 103 is attached to the quick coupler 1. In this state, a width W1 of the gap between the tip of the second hook 3 and the pin retaining portion 29 is less than a width W2 of the opening of the second hook 3. Moreover, the width W1 of the gap between the tip of the second hook 3 and the pin retaining portion 29 is less than the diameter of the second pin 107.

Next, operations for detaching the attachment 103 from the quick coupler 1 will be discussed. As illustrated in FIG. 7, the second end portion 23 moves rearward so as to approach the first end portion 22 due to the contraction of the hydraulic cylinder 5. As a result, the second hook 3 slides rearward so as to move away from the pin retaining portion 29 (see arrow A5). As a result, the gap between the pin retaining portion 29 and the second hook 3 becomes wider than the diameter of the second pin 107.

The second hook 3 moves as far as the stoke end toward the rear due to the contraction of the hydraulic cylinder 5. As illustrated in FIG. 8, the first end portion 22 moves forward along the support hole 26 so as to approach the second end portion 23 due to the further contraction of the hydraulic cylinder 5. As a result, the convex portion 222 passes from the receiving portion 42 of the lock member 8 to the inclined surface 43 and moves to the recessed portion 41. The convex portion 222 then rotates the lock member 8 by further moving rearward and locking with the step portion 44 (see arrow A6). As a result, the lock member 8 moves to the unlocking position and the retaining function of the first pin 106 due to the lock member 8 is released.

Next, the quick coupler 1 or the attachment 103 rotates around the first pin 106 whereby the second pin 107 is detached from between the second hook 3 and the pin retaining portion 29 (see arrow A7). The first hook 4 then is detached from the first pin 106 (see arrow A8). As described above, the attachment 103 is detached from the quick coupler 1.

Moving the lock member 8 to the locking position (arrow A3 in FIG. 5) and sliding the second hook 3 (arrow A4 in FIG. 6) may be performed in any order when attaching the attachment 103 to the quick coupler 1. Similarly, moving the lock member 8 to the unlocking position (arrow A6 in FIG. 8) or sliding the second hook 3 (arrow A5 in FIG. 7) may be performed in any order when removing the attachment 103 from the quick coupler 1.

As described above, the retaining function can be automatically carried out due to the lock member 8 when attaching the attachment 103 to the quick coupler 1 according to the present embodiment. Moreover, the retaining function can be actuated by the lock member 8 by moving the first end portion 22 of the hydraulic cylinder 5 along the support hole 26. As a result, the size of the quick coupler can be reduced.

The width W1 of the gap between the tip of the second hook 3 and the pin retaining portion 29 is less than the width W2 of the opening of the second hook 3 while the second hook 3 is nearest the pin retaining portion 29. Consequently, even if the first hook 4 is damaged, the second pin 107 is prevented from going through the gap between the tip of the second hook 3 and the pin retaining portion 29. As a result, detachment of the attachment 103 can be prevented.

The second end portion 23 is urged so that the second end portion 23 moves away from the first end portion 22 due to the first urging member 6 and the second urging member 7. As a result, even if the extension force of the hydraulic cylinder 5 is lost due to a breakdown of the hydraulic system and the like, the second hook 3 is held in place by the first urging member 6 and the second urging member 7 while the second hook 3 is locked with the second pin 107. Moreover, the lock member 8 is held in the locking position even if the extension force of the hydraulic cylinder 5 is lost because the state of the first end portion 22 being spaced away from the second end portion 23 is maintained due to the first urging member 6 and the second urging member 7. As a result, detachment of the attachment 103 can be prevented.

The elastic member 45 is inserted into the support hole 26. That is, the first connecting pin 27 receives resistance due to the elastic force when the first end portion 22 moves from the holding position to the release position. As a result, the movement toward the release position of the first end portion 22 can be delayed. Consequently, the second pin 107 is first removed from the second hook 3 and then the lock member 8 can be released. The elastic member 45 may be disposed so that the lock member 8 is released first and then the second pin 107 is removed from the second hook 3.

The wall portion 15 of the coupler body 2 is disposed facing the first end portion 22 in the extension direction of the hydraulic cylinder 5. As a result, the hydraulic cylinder 5 remains inside the coupler body 2 due to the wall portion 15 even if the first connecting pin 27 is damaged. As a result, the first pin 106 and the second pin 107 can be prevented from being respectively slipping out of the first hook 4 and the second hook 3. As a result, detachment of the attachment 103 can be prevented.

Figure 11:
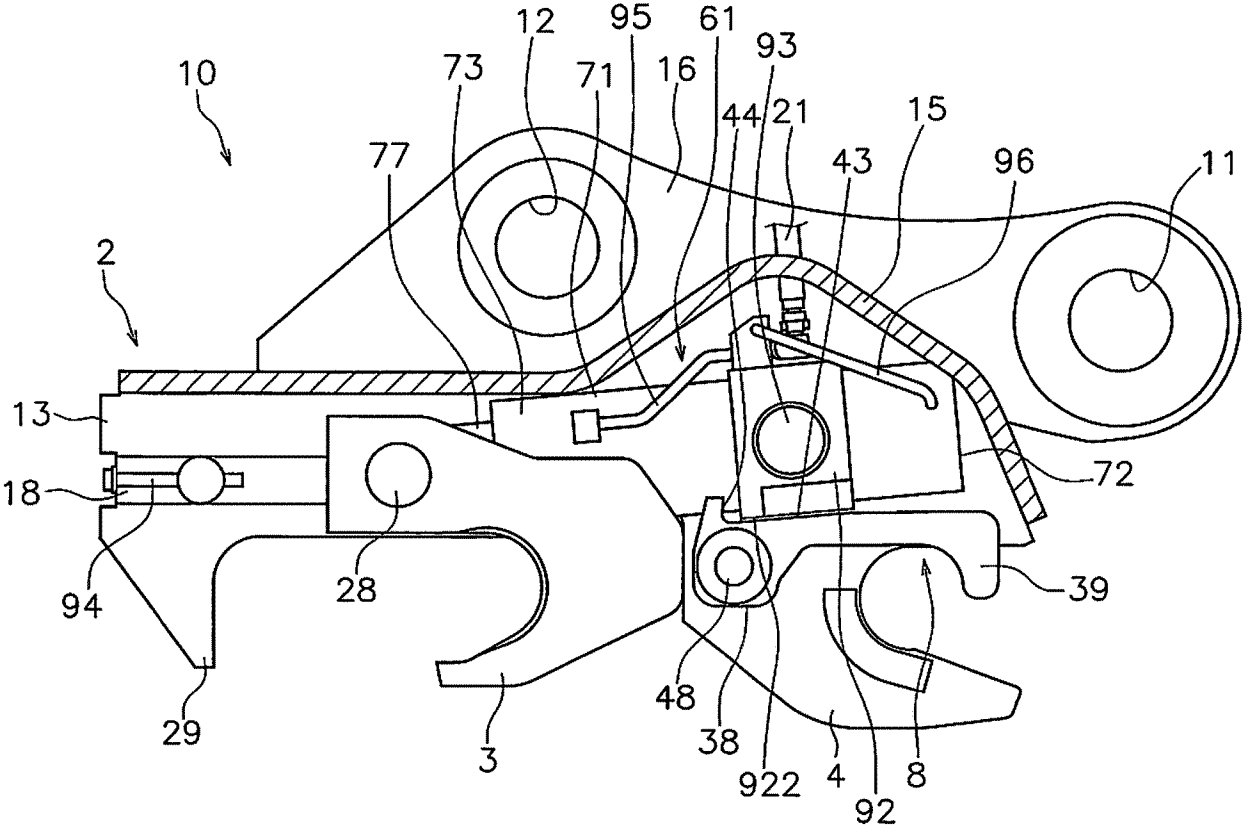
FIG. 11 is a side surface sectional view of a schematic configuration of the inside of the quick coupler according to a second embodiment.

Next, a quick coupler 10 according to a second embodiment will be explained. FIG. 11 is a side surface sectional view of a schematic configuration of the inside of the quick coupler 10 according to the second embodiment. The first urging member 6 and the second urging member 7 from the first embodiment are omitted in the quick coupler 10 according to the second embodiment, and a hydraulic cylinder 61 housing an urging member is provided in place of the first urging member 6 and the second urging member 7. The structure of the hydraulic cylinder 61 is described below.

A stopper spring member 94 for retaining the second hook 3 is provided in the groove 18 of the coupler body 2 in the quick coupler according to the second embodiment. However, the stopper spring member 94 may be omitted. The same reference numerals are attached to the components common to the first embodiment in FIG. 11 and detailed explanations of these components are omitted.

Next, the hydraulic cylinder 61 will be discussed in detail.

Figure 12:
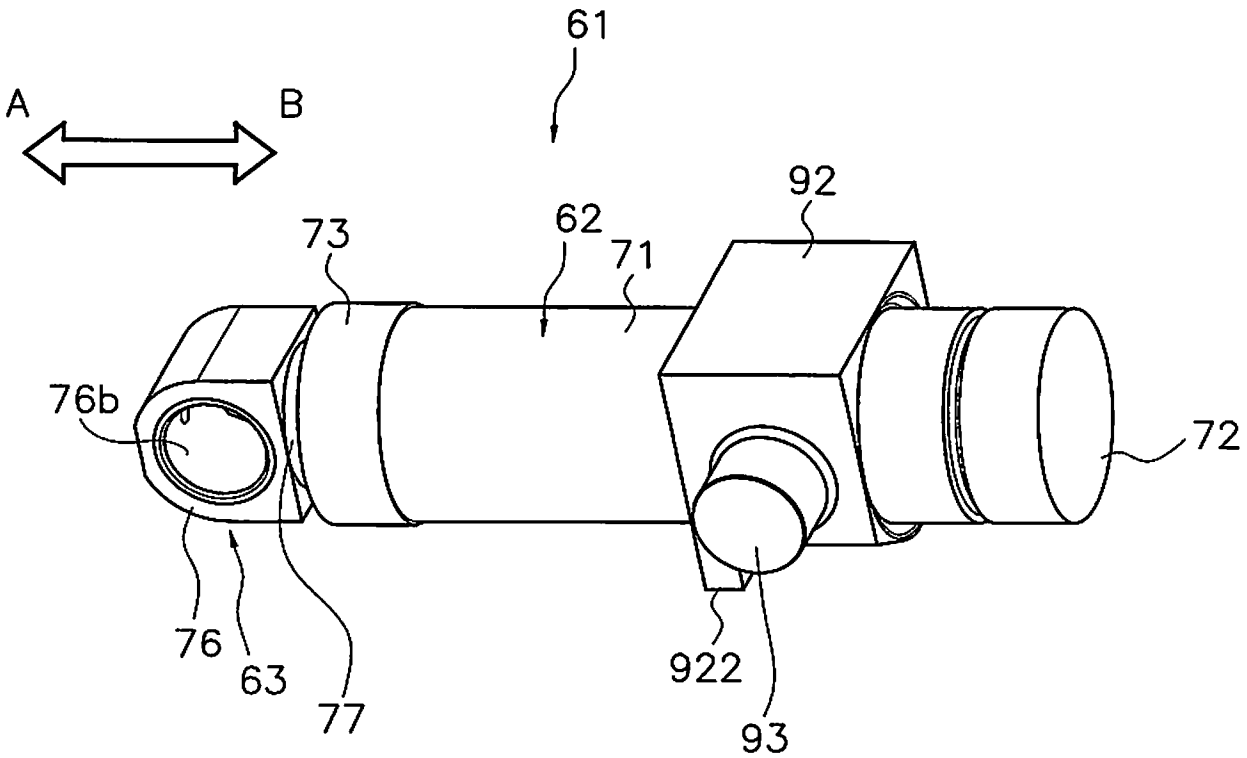
FIG. 12 is an external view of a hydraulic cylinder.
Figure 13:
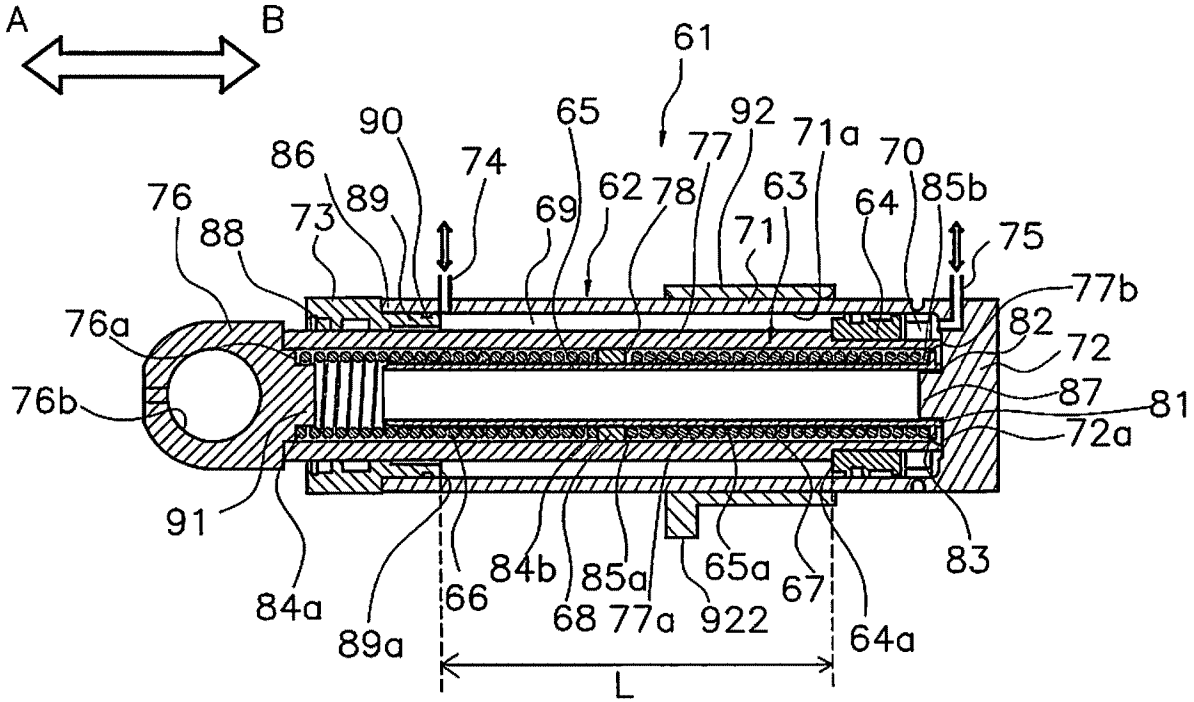
FIG. 13 is a view of the internal configuration while the hydraulic cylinder is contracted.
Figure 14:
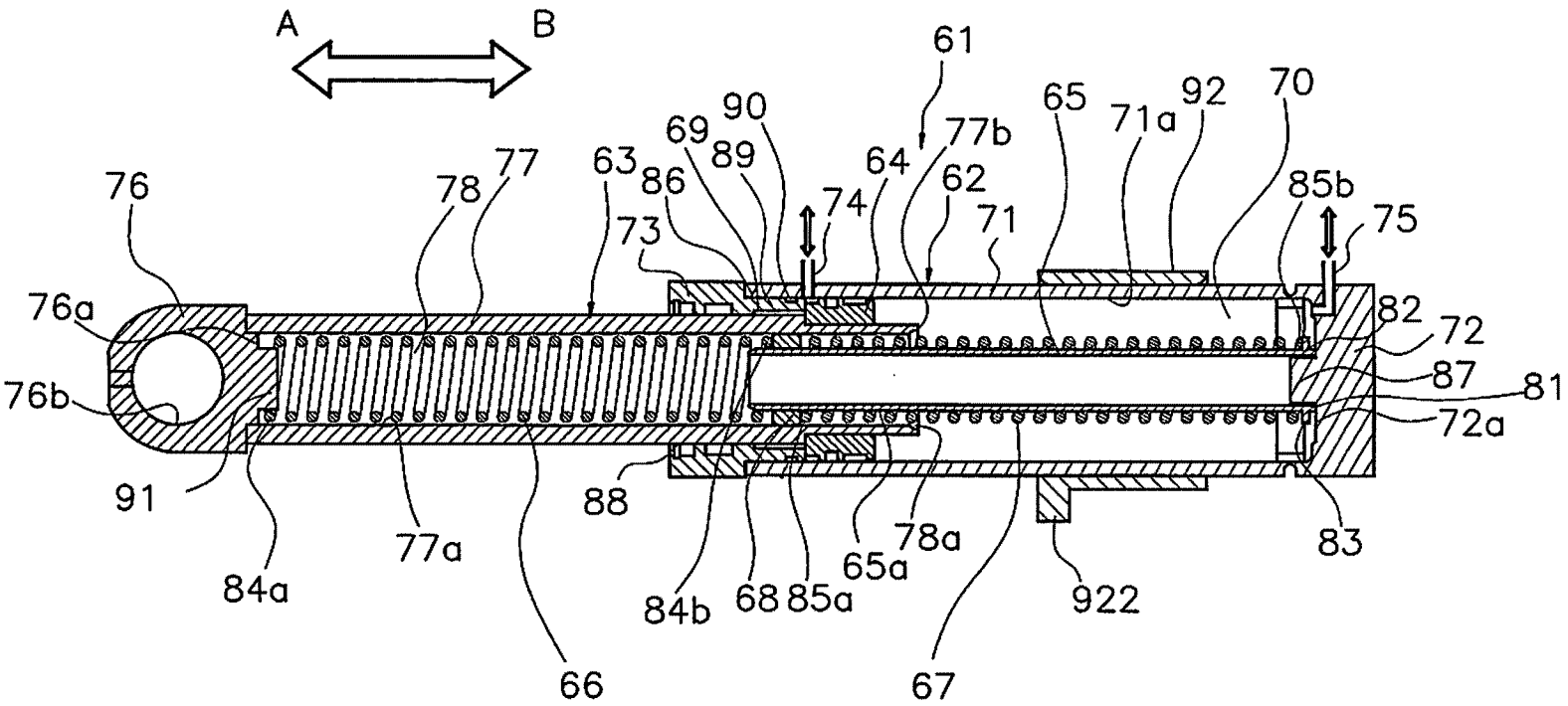
FIG. 14 is a view of the internal configuration while the hydraulic cylinder is extended.

FIG. 12 is an external view of the hydraulic cylinder 61 according to the embodiment. FIG. 13 and FIG. 14 are sectional views of the internal configuration of the hydraulic cylinder 61 of the present embodiment. FIG. 13 illustrates a contracted state of the hydraulic cylinder 61 and FIG. 14 illustrates an extended state of the hydraulic cylinder 61.

The hydraulic cylinder 61 of the present embodiment is provided with a cylinder tube 62, a piston rod 63, a piston 64, a guide member 65, a first urging member 66, a second urging member 67, and a hold ring 68.

The piston 64 of the hydraulic cylinder 61 of the present embodiment slides inside the cylinder tube 62 due to the supply of hydraulic fluid, and the piston rod 63 connected to the piston 64 extends and contracts. The extension direction of the piston rod 63 is indicated by arrow A and the direction in which the piston rod 63 is drawn into the cylinder tube 62

(also referred to as contraction direction) is indicated by arrow B. A second end portion 76 of the piston rod 63 forms a connecting portion with a member to be moved by the hydraulic cylinder 61 as illustrated in FIG. 12. The second end portion 76 includes the through-hole 76*b*. The second connecting pin 28 illustrated in FIG. 11 is inserted into the through-hole 76*b*. Consequently, the second end portion 76 is connected to the second hook 3 illustrated in FIG. 11.

As illustrated in FIG. 14, the piston rod 63 is urged in the extension direction A by the first urging member 66 and the second urging member 67.

The cylinder tube 62 is a member in which the external appearance thereof is substantially a cylinder as illustrated in FIG. 12. The cylinder tube 62 includes a cylindrical portion 71, a first end portion 72, a lid portion 73, and a support portion 92.

As illustrated in FIGS. 13 and 14, the cylindrical portion 71 has a substantially cylindrical shape with a space formed thereinside. The longitudinal direction (center axis) of the cylindrical portion 71 matches the extension and contraction direction of the piston rod 63.

The first end portion 72 is a cylindrically shaped member and is provided so as to cover the end on the contraction direction B side of the cylindrical portion 71. The first end portion 72 is joined to the cylindrical portion 71. A protruding portion 87 which protrudes in the extension direction A is formed on a bottom surface 72*a* which is the inner surface of the first end portion 72. The protruding portion 87 mates with the below mentioned guide member 65.

The lid portion 73 is provided so as to close the end in the extension direction A of the cylindrical portion 71. The lid portion 73 is a cylindrically shaped member including an insertion hole 88 into which the piston rod 63 is inserted. A sealing member is provided on the edge of the insertion hole 88 of the lid portion 73 and the sealing member seals the gap between the lid portion 73 and the piston rod 63 so that hydraulic fluid does not leak.

An insertion portion 89 which is inserted into the cylinder tube 62 is provided on the end on the contraction direction B side of the lid portion 73. The outer circumferential surface of the insertion portion 89 is formed in a threaded shape.

A threaded shape is formed on the inside of an end portion 86 on the extension direction A side of the cylindrical portion 71. The end portion 86 and the insertion portion 89 are engaged by screwing the lid portion 73 to the cylindrical portion 71.

A recessed portion 90 is formed on the outer circumference of the insertion portion 89 and an O-ring and the like is inserted into the recessed portion 90 to seal the gap between the cylindrical portion 71 and the lid portion 73.

As illustrated in FIGS. 13 and 14, a first flowpath 74 and a second flowpath 75 (omitted in FIG. 12) are formed in the cylinder tube 62 for supplying and discharging hydraulic fluid to and from the inside of the cylinder tube 62. The first flowpath 74 is formed at a position of the cylindrical portion 71 on the contraction direction B side of the lid portion 73, and forms an opening on an inner circumferential surface 71*a* of the cylindrical portion 71. The first flowpath 74 forms a rod-side port of the hydraulic cylinder 61. The second flowpath 75 is formed on the first end portion 72 and forms an opening on the bottom surface 72*a*. The second flowpath 75 forms a bottom-side port of the hydraulic cylinder 61. The first flowpath 74 is connected to a first hydraulic pipe 95 illustrated in FIG. 11. The second flowpath 75 is connected to a second hydraulic pipe 96. The first hydraulic pipe 95 and the second hydraulic pipe 96 are connected to the above-mentioned hydraulic pipe 21.

The support portion 92 is positioned between the first end portion 72 and the lid portion 73 in the longitudinal direction of the cylinder tube 62. Specifically, the support portion 92 is positioned between the first end portion 72 and the cylindrical portion 71 in the longitudinal direction of the cylinder tube 62. The support portion 92 includes a convex portion 922 that corresponds to the convex portion 222 of the first embodiment. Moreover, a first connecting pin 93 which corresponds to the first connecting pin 27 of the first embodiment is provided on the support portion 92. The cylinder tube 62 is supported by the coupler body 2 via the first connecting pin 93.

The piston rod 63 is inserted into the insertion hole 88 of the lid portion 73 in a manner that allows movement in the longitudinal direction (extension and contraction direction), and the longitudinal direction of the piston rod 63 matches the extension and contraction direction.

The piston rod 63 includes a cylindrically shaped cylindrical portion 77 including openings at both ends, and the second end portion 76 disposed so as to close the opening on the extension direction A side of the cylindrical portion 77. As a result, an internal space 78 which extends in the extension direction A from an end surface 77*b* on the contraction direction B side of the cylindrical portion 77, is formed in the piston rod 63.

That is, the internal space 78 is formed by being enclosed by an inner circumferential surface 77*a* of the cylindrical portion 77 and an inside surface 76*a* on the contraction direction B of the second end portion 76. The internal space 78 includes an opening 78*a* (see FIG. 14) on the contraction direction B side.

A connecting portion for connecting the members driven by the abovementioned hydraulic cylinder 61 is formed on the second end portion 76 which is the end on the extension direction A side.

The piston 64 is a toric member and is fixed to the outer circumference of the piston rod 63. The piston 64 is disposed in the proximity of the end surface 77*b* on the contraction direction B side of the piston rod 63. The piston 64 slides over the inner circumferential surface 71*a* of the cylindrical portion 71 of the cylinder tube 62.

The space inside the cylinder tube 62 is divided by the piston 64 into a first space 69 on the extension direction A side of the piston 64 and a second space 70 on the contraction direction B of the piston 64. The first flowpath 74 is connected to the first space 69 and the second flowpath 75 is connected to the second space 70.

The piston rod 63 is inserted into the piston 64 and the end surface 77*b* on the contraction direction B of the piston rod 63 abuts the bottom surface 72*a* in the contracted state illustrated in FIG. 13.

The guide member 65 is a cylindrical member for guiding the below mentioned first urging member 66 and the second urging member 67, and is disposed inside the cylinder tube 62 so that the longitudinal direction of the guide member 65 extends in the extension and contraction direction. The guide member 65 is disposed on the inside in the radial direction of the cylindrical portion 77 of the piston rod 63 in the hydraulic cylinder 61 (FIG. 13) in the contracted state.

The guide member 65 includes an opening 82 in an end 81 in the contraction direction B and the protruding portion 87 is mated with the opening 82. The end 81 of the guide member 65 is held in the middle of the bottom surface 72*a* due to the protruding portion 87 mating with the end 81 in this way.

A protrusion 83 is formed around the circumference protruding toward the outside in the radial direction in the proximity of the bottom surface 72*a* of the guide member 65. An end 85*b* on the contraction direction B side of the below mentioned second urging member 67 abuts with the protrusion 83.

The guide member 65 is formed so that the length in the extension and contraction direction of the guide member 65 overlaps the piston rod 63 in the state in which the piston rod 63 is extended the most as illustrated in FIG. 14.

The first urging member 66 and the second urging member 67 have coil shapes and are disposed in a row in the extension and contraction direction. The first urging member 66 and the second urging member 67 are coil springs. However, the first urging member 66 and the second urging member 67 may be members other than coil springs.

The first urging member 66 and the second urging member 67 are disposed so that the center axes thereof follow the extension and contraction direction. The first urging member 66 and the second urging member 67 are inserted into the internal space 78 of the piston rod 63 and are disposed between the outer circumferential surface 65*a* of the guide member 65 and the inner circumferential surface 77*a* of the piston rod 63. The first urging member 66 is disposed on the extension direction A side of the second urging member 67.

A protruding portion 91 which protrudes in the contraction direction B is formed on the inside surface 76*a* on the contraction direction B side of the second end portion 76. An end 84*a* on the extension direction A side of the first urging member 66 is formed on the ring-like gap formed between the protruding portion 91 and the cylindrical portion 77.

The end 85*b* on the contraction direction B side of the second urging member 67 abuts with the protrusion 83.

The hold ring 68 is a member for holding the guide member 65 in the approximate middle of the internal space 78, and is disposed between the outer circumferential surface 65*a* of the guide member 65 and the inner circumferential surface 77*a* of the piston rod 63. The hold ring 68 is disposed between an end 84*b* on the contraction direction B side of the first urging member 66 and an end 85*a* on the extension direction A side of the second urging member 67, and the ends 84*b* and 85*a* abut with the hold ring 68.

The hold ring 68 slides over the outer circumferential surface 65*a* of the guide member 65 and the inner circumferential surface 77*a* of the piston rod 63 during extension and contraction. The hold ring 68 is disposed in approximately the middle in the extension and contraction direction of the guide member 65 in FIG. 13. As illustrated in FIG. 14, the hold ring 68 is positioned between the outer circumferential surface 65*a* of the guide member 65 and the inner circumferential surface 77*a* of the piston rod 63 while the piston rod 63 is extended the most.

By providing the hold ring 68 in this way, the guide member 65 is held in approximately the middle of the piston rod 63 by the hold ring 68. The guide member 65 is held by the hold ring 68 and the end 81 of the guide member 65 is held in the middle of the bottom surface 72*a* by the protruding portion 87. In this way, the guide member 65 is held in two locations and is disposed with precision in the middle of the piston rod 63.

As described above, the first urging member 66, the hold ring 68, and the second urging member 67 are disposed in order from the extension direction A side, and the first urging member 66 and the second urging member 67 elastically urge the piston rod 63 in the extension direction A.

The first urging member 66, the second urging member 67, and the hold ring 68 are not joined to other members and are fit loosely with the guide member 65. Moreover, the guide member 65 is engaged only with the protruding portion 87 of the cylinder tube 62 and is not joined to the first end portion 72.

As a result, the hydraulic cylinder 61 can be assembled easily by performing: a step for disposing the second urging member 67, the hold ring 68, and the first urging member 66 in order on the guide member 65; a step for fitting, to the protruding portion 87, the guide member 65 including the second urging member 67, the hold ring 68, and the first urging member 66 disposed thereon; and a step for attaching by screwing the lid portion 73 onto the cylindrical portion 77 while inserting the piston rod 63.

Hydraulic fluid is supplied into the first space 69 in the contracted state illustrated in FIG. 13, and a force on the contraction direction B side is applied to the piston 64 by the hydraulic pressure of the hydraulic fluid. Moreover, the piston rod 63 is urged in the extension direction A by the first urging member 66 and the second urging member 67. The piston 64 is pushed in the contraction direction B by the hydraulic pressure of the hydraulic fluid with respect to the urging force of the springs.

When the hydraulic fluid is supplied to the second space 70 via the second flowpath 75 and the hydraulic fluid is discharged from the first space 69, the piston 64 slides inside the cylinder tube 62 and moves in the extension direction A due to the hydraulic pressure from the state of the hydraulic cylinder 61 being contracted illustrated in FIG. 13. As a result, the piston rod 63 connected to the piston 64 moves in the extension direction A.

At this time, the piston 64 moves in the extension direction A due to the hydraulic pressure and the urging force of the first urging member 66 and the second urging member 67.

The piston rod 63 and the piston 64 then moves in the extension direction A until the end surface 64*a* on the extension direction A side of the piston 64 abuts the end surface 89*a* on the contraction direction B side of the insertion portion 89 of the lid portion 73.

As a result, a stroke L attains the length between the end surface 64*a* and the end surface 89*a* in the hydraulic cylinder 61 of the present embodiment.

The piston rod 63 is held in the extended state due to the hydraulic pressure brought about by the hydraulic fluid supplied to the second space 70, and due to the urging force from the first urging member 66 and the second urging member 67 in the extended state illustrated in FIG. 14.

The extended state illustrated in FIG. 14 is maintained even if the hydraulic pressure is not applied to the second space 70 because the piston rod 63 is urged in the extension direction A by the first urging member 66 and the second urging member 67.

That is, the hydraulic cylinder 61 of the present embodiment is able to maintain the extended state even when hydraulic pressure is not applied to the second space 70.

The hydraulic cylinder 61 of the present embodiment is provided with the cylinder tube 62, the piston rod 63, piston 64, the first urging member 66 and the second urging member 67 (examples of spring members). The piston rod 63 is inserted into the cylinder tube 62 such that the longitudinal direction of the piston rod 64 extends in the extension and contraction direction (extension direction A and contraction direction B). The piston 64 is fixed to the piston rod 63 and slides on the inner circumferential surface 71*a* of the cylinder tube 62. The first urging member 66 and the second urging member 67 are disposed in the extension and contraction direction of the piston rod 63 and urge the piston rod 63 in the extension direction A. The piston rod 63 includes the opening 78*a* at the end surface 77*b* on the contraction direction B side and the internal space 78 extending in the extension direction A from the opening 78*a* is formed in the piston rod 63. The first urging member 66 and the second urging member 67 are inserted into the internal space 78.

In this way, the internal space 78 is formed inside the piston rod 63 and the first urging member 66 and the second urging member 67 are inserted into the internal space 78. Accordingly, the first urging member 66 and the second urging member 67 only contract until the end surface 77*b* of the piston rod 63 abuts the bottom surface 72*a* of the cylinder tube 62. That is, excessive contraction of the first urging member 66 and the second urging member 67 does not occur even without the provision of a spring seat.

As a result, a large stroke can be attained without increasing the size of the hydraulic cylinder.

Moreover, the piston rod 63 is urged in the extension direction A and the extension state is maintained by the first urging member 66 and the second urging member 67 even if no hydraulic fluid is supplied.

The hydraulic cylinder 61 of the abovementioned embodiment is further provided with the cylindrically shaped guide member 65. The first urging member 66 and the second urging member 67 have coil shapes. The guide member 65 is disposed inside the first urging member 66 and the second urging member 67 so that the longitudinal direction of the guide member 65 follows the extension and contraction direction. The end 81 (example of one end) of the guide member 65 is held on the bottom surface 72*a* of the cylinder tube 62 facing the end surface 77*b* of the piston rod 63.

As a result, buckling of the first urging member 66 and the second urging member 67 can be prevented because the guide member 65 is able to guide the first urging member 66 and the second urging member 67 in the extension and contraction direction. As a result, the length of the piston rod 63 can be increased and the stroke can be further increased.

Moreover, the position of the guide member 65 can be held in a predetermined position (for example, the middle) inside the cylinder tube 62.

At least the end 81 (example of one end) side of the guide member 65 has a cylindrical shape in the hydraulic cylinder 61 of the above embodiment. The cylinder tube 62 includes the protruding portion 87 that protrudes from the bottom surface 72*a* in the extension direction A. The end 81 (one end) of the guide member 65 is held on the bottom surface 72*a* by fitting with the protruding portion 87 in the inside of the cylindrical shape.

The guide member 65 is held on the bottom surface 72*a* with the simple assembly of fitting the guide member 65 onto the protruding portion 87 in this way, and the end 81 of the guide member 65 can be held in the middle of the bottom surface 72*a* as illustrated in FIGS. 13 and 14.

The first urging member 66 and the second urging member 67 of the hydraulic cylinder 61 of the above embodiment have coil shapes. The length of the first urging member 66 and the second urging member 67 is less than the natural length in the state in which the hydraulic cylinder 61 is extended the most.

In this way, because the length of the first urging member 66 and the second urging member 67 is shorter than the natural length in the state in which the piston rod 63 is extended the most from the cylinder tube 62, the piston rod 63 is maintained in the extended state by the first urging member 66 and the second urging member 67 even when no hydraulic fluid is supplied.

The hydraulic cylinder 61 of the above embodiment is further provided with the hold ring 68 (example of the ring-like member). The hold ring 68 is disposed between the outer circumferential surface 65*a* of the guide member 65 and the inner circumferential surface 77*a* of the internal space 78 and slides on the outer circumferential surface 65*a* and the inner circumferential surface 77*a*. The first urging member 66 and the second urging member 67 are divided by being disposed on either side of the hold ring 68.

Due to the hold ring 68 being disposed in this way, the guide member 65 is held by the hold ring 68 as well as the bottom surface 72*a* and the guide member 65 can be held more reliably in the predetermined position.

Moreover, because the guide member 65 is fitted onto the protruding portion 87, the guide member 65 can be held in two locations by merely fitting the hold ring 68 on the guide member 65 and the guide member 65 can be held precisely with a simple assembly.

The guide member 65 in the hydraulic cylinder 61 of the above embodiment includes the protrusion 83. The protrusion 83 protrudes toward the outside in the radial direction. The end 84*a* on the extension direction A side of the first urging member 66 abuts the inside surface 76*a* on the extension direction A side of the internal space 78, and the end 85*b* on the contraction direction B side of the second urging member 67 abuts the protrusion 83.

Due to the above configuration, the extension state is maintained by the first urging member 66 and the second urging member 67 even if no hydraulic fluid is supplied.

The piston rod 63 is urged in the extension direction A and the extension state is maintained by the first urging member 66 and the second urging member 67.

While the end 85*b* of the second urging member 67 in the above embodiment abuts the protrusion 83 of the guide member 65, the protrusion 83 may not be provided and the end 85*b* may abut the bottom surface 72*a*.

Moreover, while the protrusion 83 is formed in the proximity of the bottom surface 72*a* in the above embodiment, the protrusion 83 is not limited in this way and the protrusion 83 may be formed further to the extension direction A side than indicated in FIG. 13.

While the protruding portion 91 is provided on the inside surface 76*a* of the second end portion 76 and the end 84*a* of the first urging member 66 is fitted between the protruding portion 91 and the cylindrical portion 77 in the above embodiment, the protruding portion 91 may not be provided and the end 84*a* may only abut the inside surface 76*a*.

While the first urging member 66 and the second urging member 67 are provided by being divided by the hold ring 68 in the above embodiment, the first urging member 66 and the second urging member 67 may be further divided.

While the guide member 65 is not joined to the first end portion 72 and the first urging member 66, the second urging member 67, and the hold ring 68 are not joined together for the easy assembling in the above embodiment, the above members may be joined by welding and the like.

Figure 15:
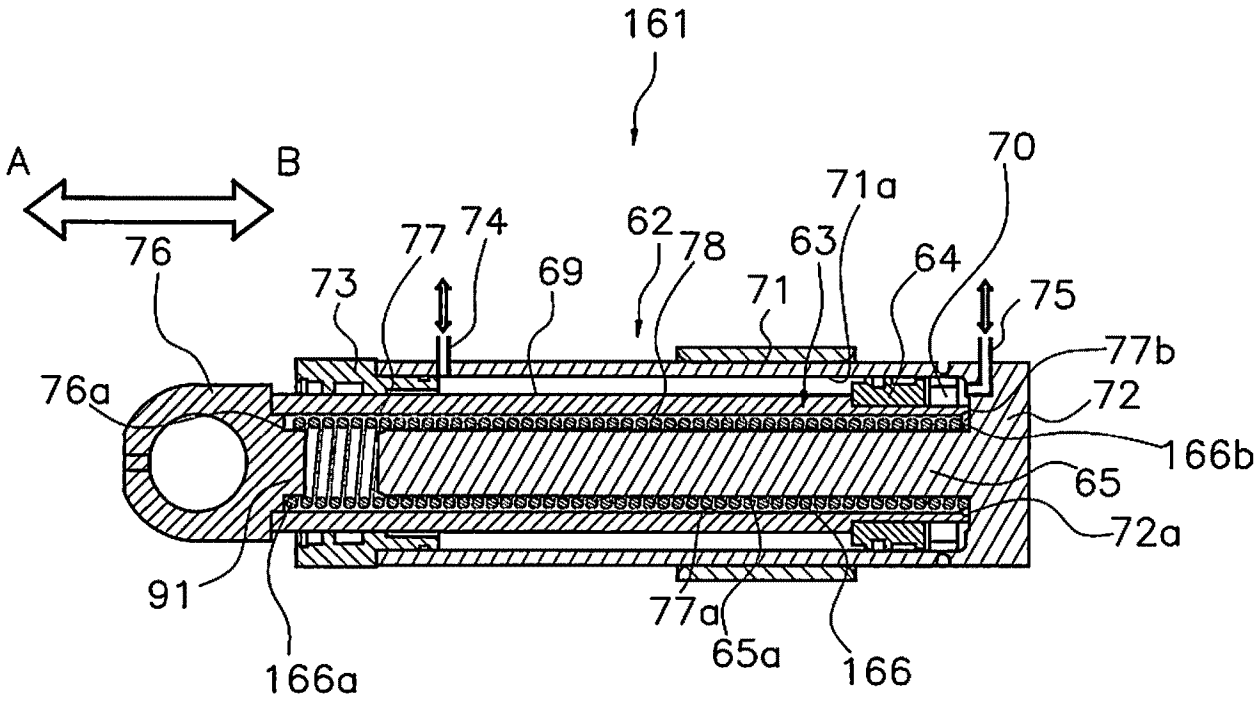
FIG. 15 is a view of the internal configuration while the hydraulic cylinder is contracted according to a modified example.
Figure 16:
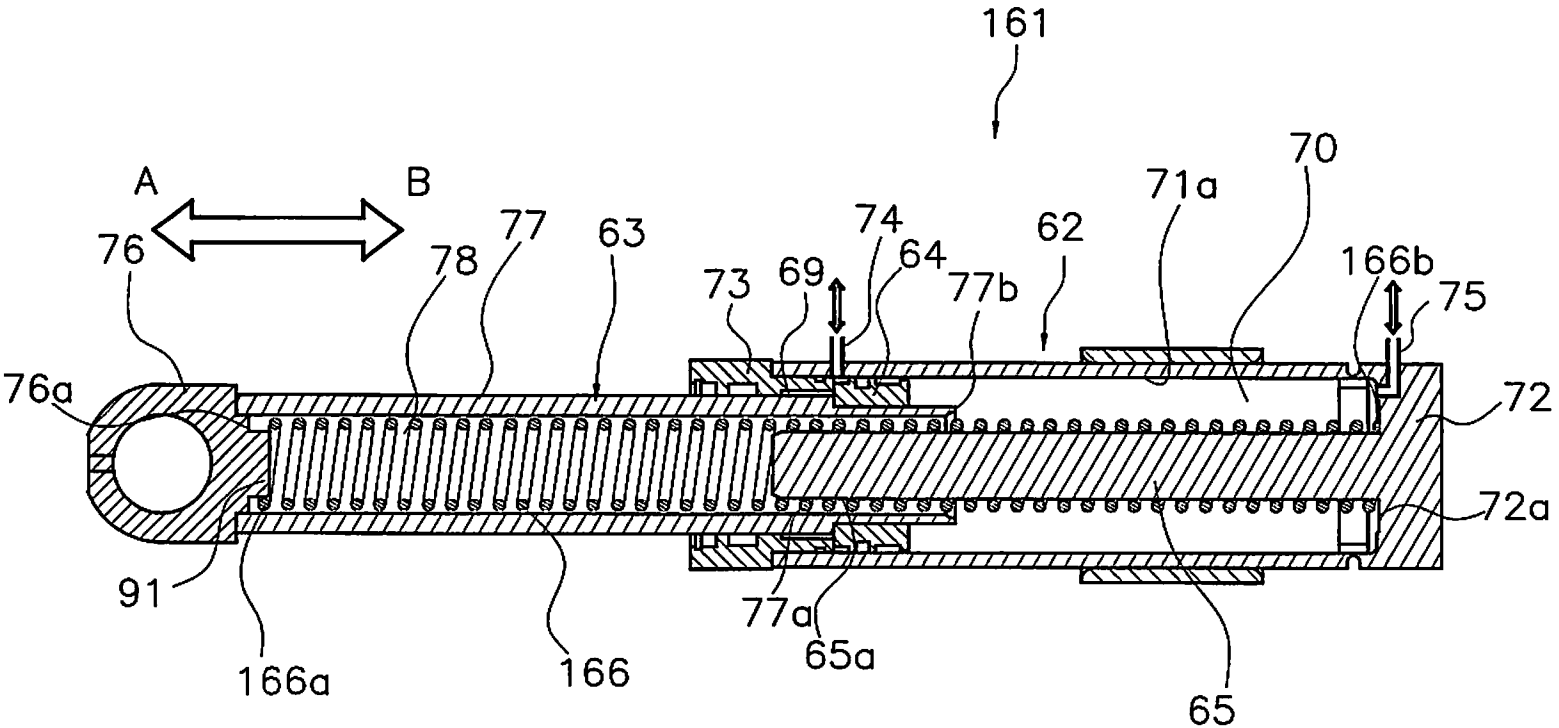
FIG. 16 is a view of the internal configuration while the hydraulic cylinder in FIG. 15 is extended.

While the hold ring 68 is provided and the first urging member 66 and the second urging member 67 are provided on either side of the hold ring 68 in the above embodiment, the hold ring 68 may not be provided and the two urging members may not be divided. FIGS. 15 and 16 are sectional views of a configuration of a hydraulic cylinder 161 not provided with the hold ring 68. FIG. 15 illustrates a contracted state of the hydraulic cylinder 161 and FIG. 16 illustrates an extended state of the hydraulic cylinder 161. The external appearance of hydraulic cylinder 161 is the same as that of the hydraulic cylinder 61 and is omitted.

The guide member 65 of the hydraulic cylinder 161 illustrated in FIGS. 15 and 16 is different from the guide member 65 of the hydraulic cylinder 61 of the above embodiment and is formed integrally with the first end portion 72 of the cylinder tube 62. The first end portion 72 of the hydraulic cylinder 161 differs from the first end portion 72 of the hydraulic cylinder 61. The protruding portion 87 is not formed and the cylindrically-shaped guide member 65 is formed so as to protrude in the extension direction A. The length in the extension and contraction direction of the guide member 65 is formed so as to overlap the piston rod 63 in the extended state as illustrated in FIG. 16.

Because the hold ring 68 is not provided in the hydraulic cylinder 161 illustrated in FIGS. 15 and 16, there is no need to divide the urging member into two urging members and thus one urging member 166 is provided.

The urging member 166 is disposed between the outer circumferential surface 65*a* of the guide member 65 and the inner circumferential surface 77*a* of the internal space 78. An end 166*a* on the extension direction A side of the urging member 166 is disposed between the protruding portion 91 and the cylindrical portion 77, and an end 166*b* on the contraction direction B side of the urging member 166 abuts with the bottom surface 72*a* of the cylinder tube 62 that is the inner surface of the first end portion 72.

Because the guide member 65 is formed integrally with the first end portion 72 in the hydraulic cylinder 161 illustrated in FIGS. 15 and 16, the guide member 65 can be held in the middle of the cylinder tube 62 even without the provision of the hold ring 68.

While the guide member 65 is formed integrally with the first end portion 72 in the hydraulic cylinder 161, the guide member 65 may be fixed to a second end portion 76 by welding and the like.

Figure 17:
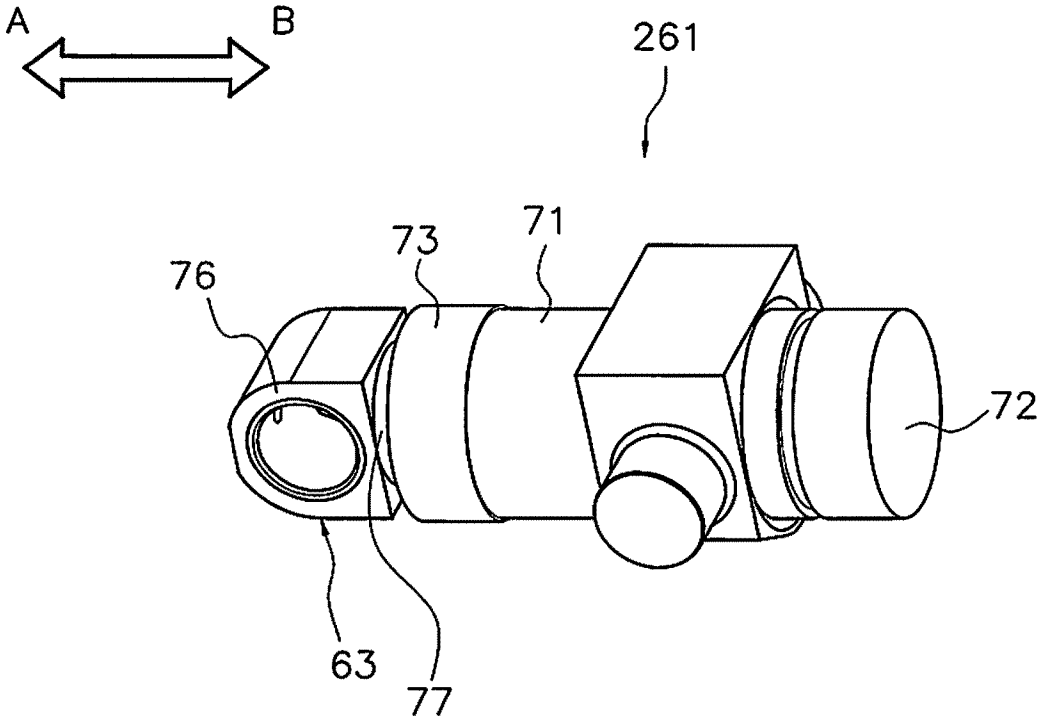
FIG. 17 is a perspective view of the external appearance of a hydraulic cylinder according to a modified example.
Figure 18:
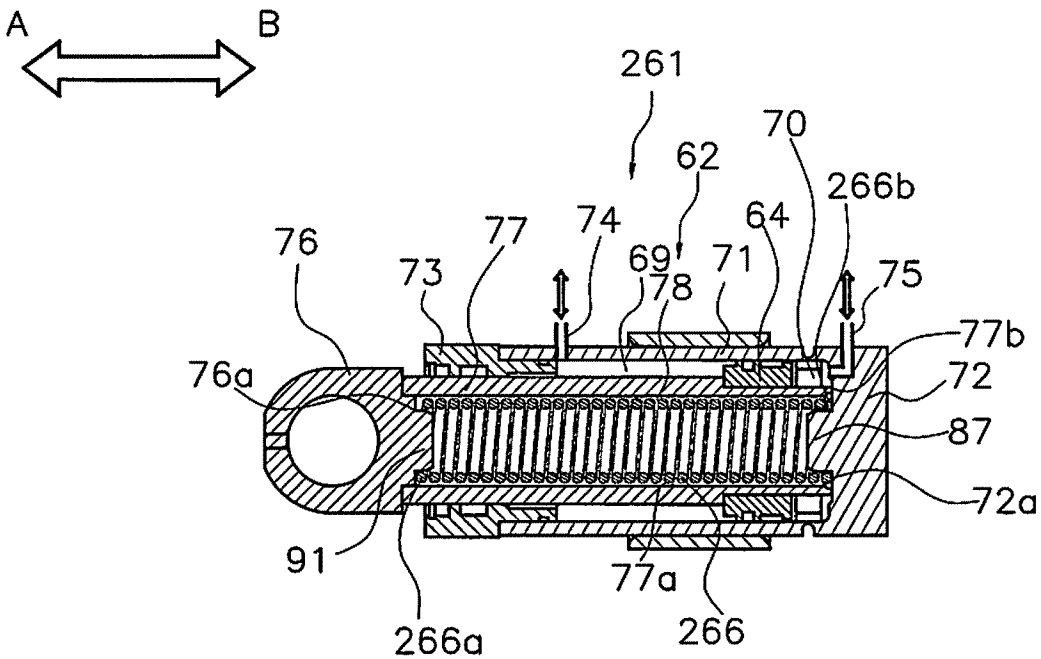
FIG. 18 is a view of the internal configuration while the hydraulic cylinder in FIG. 17 is contracted.
Figure 19:
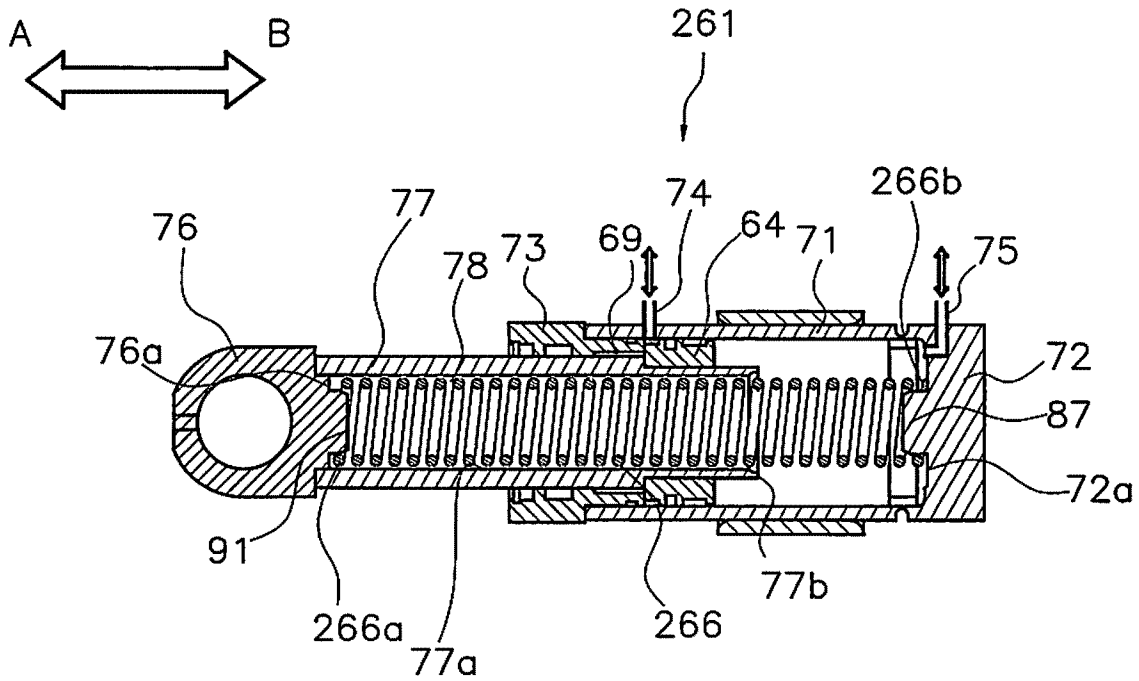
FIG. 19 is a view of the internal configuration while the hydraulic cylinder in FIG. 17 is extended.

While the guide member 65 is provided in the hydraulic cylinder 161 illustrated in FIGS. 15 and 16, the guide member 65 may not be provided. FIG. 17 illustrates an external appearance of a hydraulic cylinder 261 not provided with a guide member. FIGS. 18 and 19 are sectional views illustrating a configuration of the hydraulic cylinder 261. FIG. 18 illustrates a contracted state of the hydraulic cylinder 261 and FIG. 16 illustrates an extended state of the hydraulic cylinder 261.

As illustrated in FIGS. 18 and 19, the protruding portion 87 which protrudes in the extension direction A is formed on a bottom surface 72*a* of the cylinder tube 62 which is the inner surface of the first end portion 72. One urging member 266 is provided in the hydraulic cylinder 261 illustrated in FIGS. 18 and 19 in the same way as the hydraulic cylinder 161.

An end 266*a* on the extension direction A of the urging member 266 is fitted between the protruding portion 91 and the cylindrical portion 77. Moreover, the protruding portion 87 is fitted to the inside of an end 266*b* on the contraction direction B of the urging member 266. The position of the urging member 266 is held in the middle of the cylinder tube 62 in the extended state illustrated in FIG. 19 due to the protruding portion 87 fitting to the inside of the end 266*b* (example of a first end) of the urging member 266 in this way.

Because the guide member 65 is not provided in the hydraulic cylinder 261, the length of the urging member 166 cannot be as long as that of the hydraulic cylinder 161. As a result, while the cylindrical portion 71 of the cylinder tube 62 is formed shorter than the cylindrical portion 71 in the above hydraulic cylinder 161 as illustrated in the external view in FIG. 17, the hydraulic cylinder 261 has the advantage of having a simpler configuration than the hydraulic cylinder 161. Moreover, because a spring seat does not need to be provided even in this case, the length of the stroke can be ensured despite the size of the hydraulic cylinder 261.

The first urging member 66 and the second urging member 67 are disposed inside the hydraulic cylinder 61 in the quick coupler 10 according to the second embodiment as discussed above. As a result, the first urging member 66 and the second urging member 67 can be prevented from coming into contact with the hydraulic pipe 21 during the operation of the quick coupler 10. Moreover, the adhesion of foreign matter such as sand on the first urging member 66 and the second urging member 67 can be prevented.

Because a space for disposing the urging member inside the coupler body 2 and a space for preventing interference between the urging member and the hydraulic pipe 21 can be omitted, an increase in the size of the quick coupler 10 can be prevented.

The first connecting pin 93 is provided on the cylinder tube 62 and is disposed between the first end portion 72 and the lid portion 73 in the axial direction of the cylinder tube 62. As a result, the overall length of the hydraulic cylinder 61 can be reduced in comparison to when the first connecting pin 93 is provided on the first end portion 72 of the cylinder tube 62. Consequently, an increase in the size of the quick coupler 10 can be suppressed.

Although embodiments of the present invention have been described so far, the present invention is not limited to the above embodiments and various modifications may be made within the scope of the invention.

The shape of the support hole 26 is not limited to an elongated hole and may be changed. For example, the support hole 26 may have a circular shape or an elliptical shape larger than the first connecting pin 27.

The lock member 8 is not limited to the configuration of the above embodiments and may be changed. For example, the recessed portion 41, the inclined surface 43, or the step portion 44 may not be provided on the lock member 8. The lock member 8 may move between the locking position and the unlocking position with a linear or a curved movement instead of rotating.

The width of the gap between the tip of the second hook 3 and the pin retaining portion 29 may be equal to or greater than the width of the opening of the second hook 3 while the second hook 3 is nearest the pin retaining portion 29. Alternatively, the tip of the second hook 3 and the pin retaining portion 29 may come into contact with each other.

The urging member is not limited to a spring and may be configured as another member that produces an urging force such as an elastic material or a fluid such as a gas or a liquid. The number of the urging members is not limited to two and there may be two or more urging members, or one urging member.

The elastic member 45 may be omitted. The wall portion 15 of the coupler body 2 may be omitted.

The configuration of hydraulic cylinder 61 according to the second embodiment may be changed.

INDUSTRIAL APPLICABILITY

According to the present invention, a quick coupler can be provided that is small in size and that can enable the automatic actuation of a retaining function with the lock member when attaching the attachment.

What is claimed is:

1. A quick coupler comprising:

a coupler body including a first hook;

a lock member provided movable to a locking position in which the lock member protrudes into an opening of the first hook, and an unlocking position in which the lock member retracts from the locking position;

a second hook provided slidably with respect to the coupler body;

a hydraulic cylinder including a piston rod, a first end portion, and a second end portion, the first end portion being connected to the coupler body and the second end portion connected to the second hook, the hydraulic cylinder extending to cause the second hook to slide away from the first hook, the hydraulic cylinder contracting to cause the second hook to slide towards the first hook;

a connecting pin connecting the first end portion of the hydraulic cylinder and the coupler body; and an urging member urging the second end portion to be moved away from the first end portion, the urging member being disposed within an internal space of the piston rod, the coupler body including a support hole moveably supporting the connecting pin in an extension and contraction direction of the hydraulic cylinder, and the first end portion of the hydraulic cylinder moving away from the second end portion within a movability range of the connecting pin and thereby moving the lock member from the unlocking position to the locking position.

2. The quick coupler according to claim 1, wherein the support hole is an elongated hole that extends in the extension and contraction direction of the hydraulic cylinder.

3. The quick coupler according to claim 1, wherein the quick coupler is a member configured to attach an attachment via a first pin and a second pin, the coupler body further includes a pin retaining portion disposed facing an opening of the second hook, and a width of a gap between a tip of the second hook and the pin retaining portion is less than a diameter of the second pin while the second hook is locked with the second pin.

4. The quick coupler according to claim 1, further comprising an elastic member inserted into the support hole.

5. The quick coupler according to claim 1, wherein the lock member includes a proximal end portion rotatably supported on the coupler body, a distal end portion protruding into the opening of the first hook in the locking position, and a recessed portion positioned between the proximal end portion and the distal end part, the first end portion of the hydraulic cylinder includes a convex portion protruding towards the lock member, and the lock member is positioned in the unlocking position when the convex portion is positioned in the recessed portion.

6. The quick coupler according to claim 5, wherein the lock member includes an inclined surface connected to the recessed portion, the inclined surface is disposed in a direction from the second end portion toward the first end portion with respect to the recessed portion, and the convex portion moves from the recessed portion to the inclined surface and presses against the inclined surface in order to move the lock member from the unlocking position to the locking position.

7. The quick coupler according to claim 1, wherein the coupler body includes a wall portion disposed facing the first end portion in the extension and contraction direction of the hydraulic cylinder.

8. The quick coupler according to claim 1, wherein the first end portion of the hydraulic cylinder moves toward the second end portion within the movability range of the connecting pin in order to move the lock member from the locking position to the unlocking position.

9. The quick coupler according to claim 1, wherein the second hook includes a protruding portion, the coupler body includes a groove in which the protruding portion is disposed, the protruding portion moves along the groove in order to slide the second hook with respect to the coupler body, and a stopper member is attached to the groove to retain the second hook.

* * * * *